US011843183B2

(12) United States Patent
Luo et al.

(10) Patent No.: US 11,843,183 B2
(45) Date of Patent: Dec. 12, 2023

(54) MULTI-BAND ANTENNA STRUCTURE

(71) Applicant: Huawei Technologies Co., Ltd., Shenzhen (CN)

(72) Inventors: Bing Luo, Chengdu (CN); Weihong Xiao, Dongguan (CN); Wenfei Qin, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 358 days.

(21) Appl. No.: 17/358,417

(22) Filed: Jun. 25, 2021

(65) Prior Publication Data

US 2021/0320409 A1 Oct. 14, 2021

Related U.S. Application Data

(63) Continuation of application No. PCT/CN2019/125826, filed on Dec. 17, 2019.

(30) Foreign Application Priority Data

Dec. 27, 2018 (CN) ..... 201811615844.1

(51) Int. Cl.
*H01Q 5/30* (2015.01)
*H01Q 1/36* (2006.01)
(Continued)

(52) U.S. Cl.
CPC ..... *H01Q 5/30* (2015.01); *H01Q 1/36* (2013.01); *H01Q 15/00* (2013.01); *H01Q 19/10* (2013.01); *H01Q 21/30* (2013.01)

(58) Field of Classification Search
CPC ..... H01Q 5/30; H01Q 1/36; H01Q 15/00; H01Q 19/10; H01Q 21/30
See application file for complete search history.

(56) References Cited

U.S. PATENT DOCUMENTS 6,831,615 B2 12/2004 Gottl
2015/0036601 A1 2/2015 Kiim et al.
(Continued)

FOREIGN PATENT DOCUMENTS

CN 1404639 A 3/2003
CN 103259087 A 8/2013
(Continued)

OTHER PUBLICATIONS

"Remaining Issues on UL Data Transmission Procedure," Agenda Item: 7.1.3.3.4, Source: LG Electronics, Document for: Discussion and decision, 3GPP TSG RAN WG1 Meeting #92, R1-1802215, Athens, Greece, Feb. 26-Mar. 2, 2018, 13 pages.
(Continued)

*Primary Examiner* — Graham P Smith
(74) *Attorney, Agent, or Firm* — SLATER MATSIL, LLP

(57) ABSTRACT

A multi-band antenna structure, including a first antenna element, a second antenna element, a reflection panel, and a first parasitic structure of the first antenna element. A distance between the reflection panel and an antenna element with a higher operating frequency band is less than a distance between the reflection panel and an antenna element with a lower operating frequency band. A distance between the first antenna element and the second antenna element is less than 0.5 times a vacuum wavelength corresponding to a lower frequency bands. A distance between the first antenna element and the first parasitic structure is less than 0.5 times a vacuum wavelength corresponding to an operating frequency band of the first antenna element. A distance between the second antenna element and the first parasitic structure is less than 0.5 times a vacuum wavelength corresponding to an operating frequency band of the second antenna element.

20 Claims, 15 Drawing Sheets

(51) Int. Cl.

| | |
|---|---|
| ***H01Q 15/00*** | (2006.01) |
| ***H01Q 19/10*** | (2006.01) |
| ***H01Q 21/30*** | (2006.01) |

(56) References Cited

U.S. PATENT DOCUMENTS

| | | | |
|---|---|---|---|
| 2015/0195063 | A1 | 7/2015 | Ro et al. |
| 2016/0095104 | A1 | 3/2016 | Chen et al. |
| 2017/0366377 | A1 | 12/2017 | Papasakellariou |
| 2018/0034161 | A1 | 2/2018 | Le et al. |
| 2018/0269577 | A1 | 9/2018 | Kosaka et al. |
| 2018/0331419 | A1 | 11/2018 | Varnoosfaderani et al. |

FOREIGN PATENT DOCUMENTS

| | | | |
|---|---|---|---|
| CN | 103311658 | A | 9/2013 |
| CN | 104600439 | A | 5/2015 |
| CN | 205141139 | U | 4/2016 |
| CN | 106207456 | A | 12/2016 |
| CN | 106299670 | A | 1/2017 |
| CN | 107453044 | A | 12/2017 |
| CN | 107834198 | A | 3/2018 |
| CN | 108347318 | A | 7/2018 |
| CN | 108539383 | A | 9/2018 |
| EP | 2963736 | A1 | 1/2016 |
| GB | 2539279 | A | 12/2016 |
| WO | 2016081036 | A1 | 5/2016 |
| WO | 2018199753 | A1 | 11/2018 |

OTHER PUBLICATIONS

"Discussion on UL inter UE Tx Prioritization," Agenda Item: 7.2.6.2, Source: LG Electronics, Document for: Discussion and decision, 3GPP TSG RAN WG1 Meeting #94, R1-1808532, Gothenburg, Sweden, Aug. 20-24, 2018, 6 pages.

Bo, Y. et al., "Compact Micro-Base Station Antenna Based on FSS," Journal of Chongqing University of Posts and Telecommunications (Natural Science Edition) , vol. 30, No. 4, Aug. 2018, 31 pages.

Kraus, J.D. et al., "Antennas for All Applications," Third Edition, New York: McGraw-Hill, 2002, 158 pages.

MULTI-BAND ANTENNA STRUCTURE

CROSS-REFERENCE TO RELATED APPLICATIONS

This application is a continuation of International Application No. PCT/CN2019/125826, filed on Dec. 17, 2019, which claims priority to Patent Application No. 201811615844.1 filed on Dec. 27, 2018. The disclosures of the aforementioned applications are hereby incorporated by reference in their entireties.

TECHNICAL FIELD

This application relates to the field of antenna technologies, and in particular, to a multi-band antenna structure.

BACKGROUND

A shared aperture technology for antennas means arranging multi-band array antennas on a same aperture. Based on this, an external dimension of the multi-band array antennas can be greatly reduced, and application advantages of miniaturization, lightweight, and easy deployment can be achieved.

In the shared aperture technology, antenna elements with different frequency bands are placed close to each other. As a result, the antenna elements are seriously coupled to each other, and radiation pattern indicators of the antenna elements deteriorate and do not satisfy requirements for predetermined specification of the antenna elements. FIG. 1A is a schematic diagram of antenna elements whose operating frequency bands are 1.7 GHz to 2.7 GHz according to the prior art. In FIG. 1A, two antenna elements 11 whose operating frequency bands are 1.7 GHz to 2.7 GHz are used as an example, and the antenna element is a dual-linearly polarized antenna element with 45° polarization and 135° polarization. FIG. 1B is radiation patterns of an antenna element whose operating frequency band is 1.7 GHz to 2.7 GHz according to the prior art. As shown in FIG. 1B, when there is an antenna element with only one operating frequency band, radiation pattern indicators of the antenna element such as a gain, a beamwidth, and a polarization suppression ratio are normal. FIG. 1C is a schematic diagram of antenna elements whose operating frequency bands are 1.7 GHz to 2.7 GHz and antenna elements whose operating frequency bands are 0.7 GHz to 0.9 GHz according to the prior art. In FIG. 1C, two antenna elements 11 whose operating frequency bands are 1.7 GHz to 2.7 GHz and two antenna elements 12 whose operating frequency bands are 0.7 GHz to 0.9 GHz are used as an example, and the two types of antenna elements are both dual-linearly polarized antenna elements with 45° polarization and 135° polarization. As shown in FIG. 1C, when an antenna element whose operating frequency band is 1.7 GHz to 2.7 GHz is placed close to an antenna element whose operating frequency band is 0.7 GHz to 0.9 GHz, radiation pattern indicators of antenna elements of the foregoing types deteriorate to different degrees. Typical phenomena include a beamwidth and a gain fluctuate greatly with frequencies, a gain fluctuates relatively greatly with a change of a spatial direction, drops (nulls) or peaks (ridge points) occur in different directions, and a polarization suppression ratio deteriorates. For example, FIG. 1D is another schematic diagram of radiation patterns of an antenna element whose operating frequency band is 1.7 GHz to 2.7 GHz according to the prior art. As shown in FIG. 1D, after an antenna element whose operating frequency band is 0.7 GHz to 0.9 GHz is added, problems such as polarization suppression ratio deterioration (a cross-polarization radiation increase shown by dashed lines) and a gain drop occur, at some frequencies, in a radiation pattern of the antenna element whose operating frequency band is 1.7 GHz to 2.7 GHz.

SUMMARY

This application provides a multi-band antenna structure, to resolve problems such as polarization suppression ratio deterioration and a gain drop that occur, at some frequencies, in a radiation pattern of an antenna element with a specific frequency band.

According to a first aspect, this application provides a multi-band antenna structure, including a first antenna element, a second antenna element, a reflection panel, and a first parasitic structure of the first antenna element. Operating frequency bands of the first antenna element and the second antenna element are different. The first antenna element, the second antenna element, and the first parasitic structure are disposed above the reflection panel. A distance between the reflection panel and an antenna element with a higher operating frequency band in the first antenna element and the second antenna element is less than a distance between the reflection panel and an antenna element with a lower operating frequency band in the first antenna element and the second antenna element. The first parasitic structure includes one or more frequency selective surface (FSS) planes, and the first parasitic structure has a stopband characteristic for the first antenna element and has a passband characteristic for the second antenna element. The first antenna element and the second antenna element are adjacent to each other, and a distance between the first antenna element and the second antenna element is less than 0.5 times a vacuum wavelength corresponding to the lower of the operating frequency bands of the first antenna element and the second antenna element. A distance between the first antenna element and the first parasitic structure is less than 0.5 times a vacuum wavelength corresponding to an operating frequency band of the first antenna element. A distance between the second antenna element and the first parasitic structure is less than 0.5 times a vacuum wavelength corresponding to an operating frequency band of the second antenna element.

The first parasitic structure includes the one or more FSS planes, and the first parasitic structure has the stopband characteristic for the first antenna element and has the passband characteristic for the second antenna element. That is, the first parasitic structure is equivalent to a continuous metal conductor in the operating frequency band of the first antenna element, and is equivalent to a vacuum in the operating frequency band of the second antenna element. This can implement a desired "targeting" optimization function. In this way, problems such as polarization suppression ratio deterioration and a gain drop that occur, at some frequencies, in a radiation pattern of the first antenna element can be resolved, and performance of the second antenna element is not markedly affected.

In a possible design, reflectivity of the first parasitic structure relative to the first antenna element is greater than 60%, a reflection phase shift ranges from 135 degrees to 225 degrees, transmittance of the first parasitic structure relative to the second antenna element is greater than 60%, and a transmission phase shift ranges from −45 degrees to 45 degrees.

In a possible design, when the first parasitic structure includes a plurality of FSS planes, structures of the FSS planes are identical or different.

In a possible design, the FSS plane is disposed between a top of the first antenna element and the reflection panel, and an included angle between the FSS plane and the reflection panel is greater than 30 degrees.

In a possible design, the FSS plane is formed by evenly arranging a plurality of FSS cells. This can better implement the desired "targeting" optimization function. In this way, the problems such as polarization suppression ratio deterioration and a gain drop that occur, at some frequencies, in the radiation pattern of the first antenna element can be resolved, and the performance of the second antenna element is not markedly affected.

In a possible design, the FSS cell is of a closed annular conductor structure or a closed annular slotted structure.

In a possible design, the closed annular conductor structure includes a bent winding pattern structure, and the closed annular slotted structure includes a bent winding pattern structure. With such a miniaturized FSS cell, "targeting" optimization can be performed on the radiation pattern of the first antenna element, and a radiation pattern of the second antenna element in adjacent space is not affected while the radiation pattern of the first antenna element is optimized.

In a possible design, a minimum width of a conductor strip or a slotted strip in the bent winding pattern structure is less than 0.02 times a maximum vacuum wavelength of the first antenna element. Therefore, "targeting" optimization can be performed on the radiation pattern of the first antenna element, and the radiation pattern of the second antenna element in the adjacent space is not affected while the radiation pattern of the first antenna element is optimized.

In a possible design, the FSS cell is of a non-rotationally symmetric structure, so that the first parasitic structure can be better applicable to a near-field region.

In a possible design, a shape of the FSS cell is rectangular or circular.

In a possible design, when the shape of the FSS cell is rectangular, a maximum side length of the FSS cell is less than 0.2 times the maximum vacuum wavelength of the first antenna element, or when the shape of the FSS cell is circular, a diameter of the FSS cell is less than 0.2 times the maximum vacuum wavelength of the first antenna element.

In a possible design, an area of the FSS plane is less than a 1-square vacuum wavelength of the first antenna element.

In a possible design, the multi-band antenna structure includes a plurality of first parasitic structures and an antenna array that includes a plurality of first antenna elements, where the plurality of first antenna elements are in a one-to-one correspondence with the plurality of first parasitic structures, and distances between the first antenna elements and the corresponding first parasitic structures are the same.

In a possible design, the multi-band antenna structure further includes a second parasitic structure, where the second parasitic structure is disposed above the reflection panel, the second parasitic structure includes one or more FSS planes, and the second parasitic structure has a passband characteristic for the first antenna element and has a stopband characteristic for the second antenna element, and a distance between the first antenna element and the second parasitic structure is less than 0.5 times the vacuum wavelength corresponding to the operating frequency band of the first antenna element, and a distance between the second antenna element and the second parasitic structure is less than 0.5 times the vacuum wavelength corresponding to the operating frequency band of the second antenna element.

In a possible design, the multi-band antenna structure further includes a third antenna element and a third parasitic structure, where an operating frequency band of the third antenna element is different from the operating frequency bands of both the first antenna element and the second antenna element, and the third antenna element and the third parasitic structure are disposed above the reflection panel, and the third parasitic structure includes one or more FSS planes, the third parasitic structure has a stopband characteristic for the third antenna element and has a passband characteristic for the first antenna element and the second antenna element, and both the first parasitic structure and the second parasitic structure have a passband characteristic for the third antenna element.

According to the multi-band antenna structure provided in this application, a parasitic structure includes one or more FSS planes, and the parasitic structure has a stopband characteristic for an antenna element that needs to be optimized and has a passband characteristic for an antenna element with another frequency bands. Therefore, the parasitic structure is equivalent to a continuous metal conductor in the frequency band for which optimization is expected to be performed, and is equivalent to a vacuum in the frequency band that is not expected to be affected. This can implement a desired "targeting" optimization function, so that the problems such as polarization suppression ratio deterioration and a gain drop that occur, at some frequencies, in a radiation pattern of an antenna element with a specific frequency band can be resolved. In addition, the FSS plane of the parasitic structure may be formed by evenly arranging a plurality of FSS cells. This can better implement the desired "targeting" optimization function, so that the problems such as polarization suppression ratio deterioration and a gain drop that occur, at some frequencies, in a radiation pattern of an antenna element with a specific frequency band can be resolved. Further, in this application, the FSS cell may be a miniaturized FSS cell. Therefore, "targeting" optimization can be performed on a radiation pattern of an antenna element with a specific frequency band, and a radiation pattern of an antenna element in adjacent space that operates in another frequency bands is not affected while the radiation pattern of the antenna element with the specific frequency band is optimized. Furthermore, in this application, the FSS cell may use a non-rotationally symmetric structure, so that the parasitic structure can be better applicable to a near-field region.

DETAILED DESCRIPTION OF ILLUSTRATIVE EMBODIMENTS

Figure 1A:
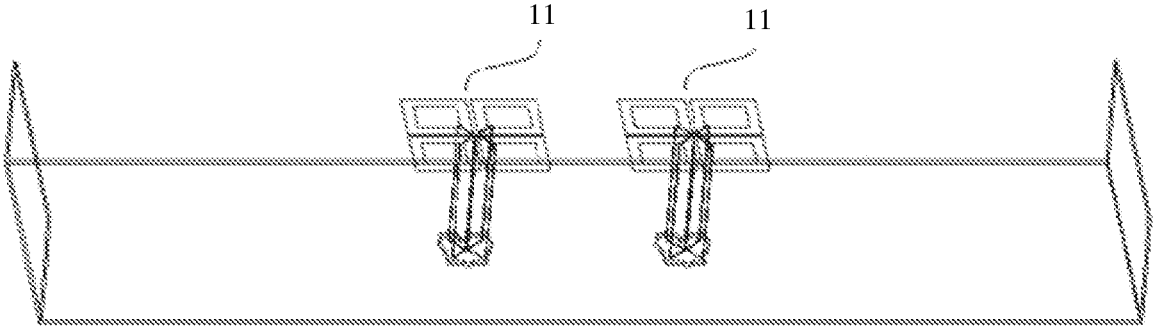
FIG. 1A is a schematic diagram of antenna elements whose operating frequency bands are 1.7 GHz to 2.7 GHz according to the prior art.
Figure 1B:
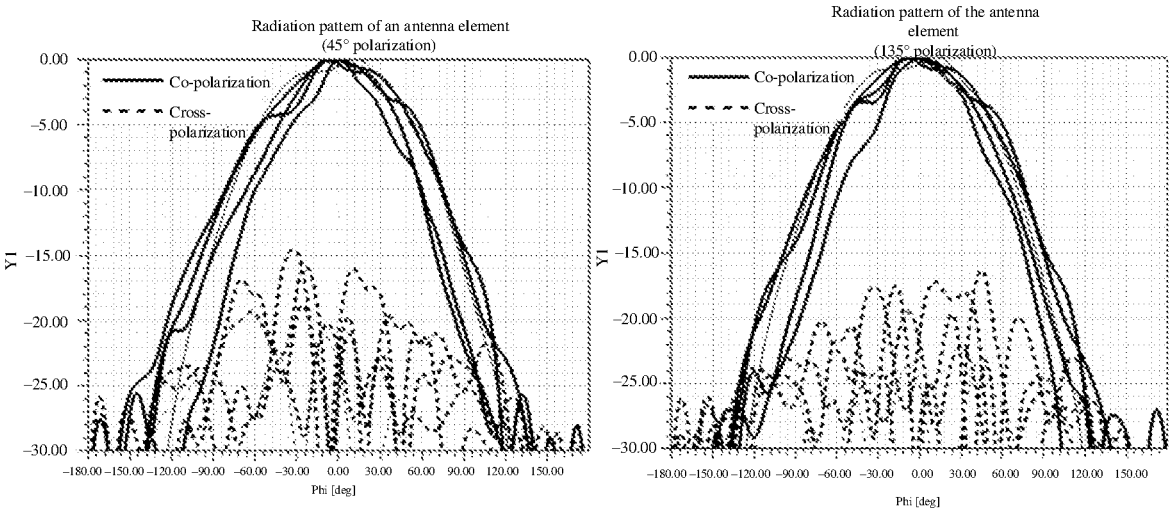
FIG. 1B is radiation patterns of an antenna element whose operating frequency band is 1.7 GHz to 2.7 GHz according to the prior art.
Figure 1C:
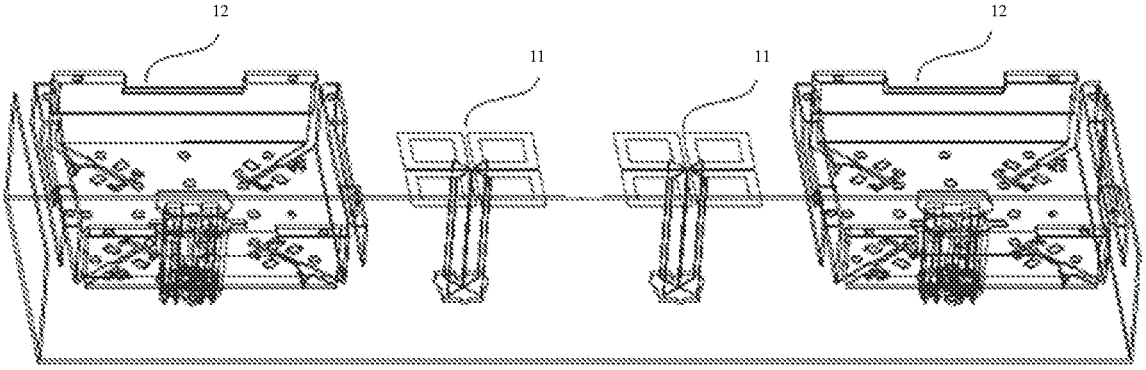
FIG. 1C is a schematic diagram of antenna elements whose operating frequency bands are 1.7 GHz to 2.7 GHz and antenna elements whose operating frequency bands are 0.7 GHz to 0.9 GHz according to the prior art.
Figure 1D:
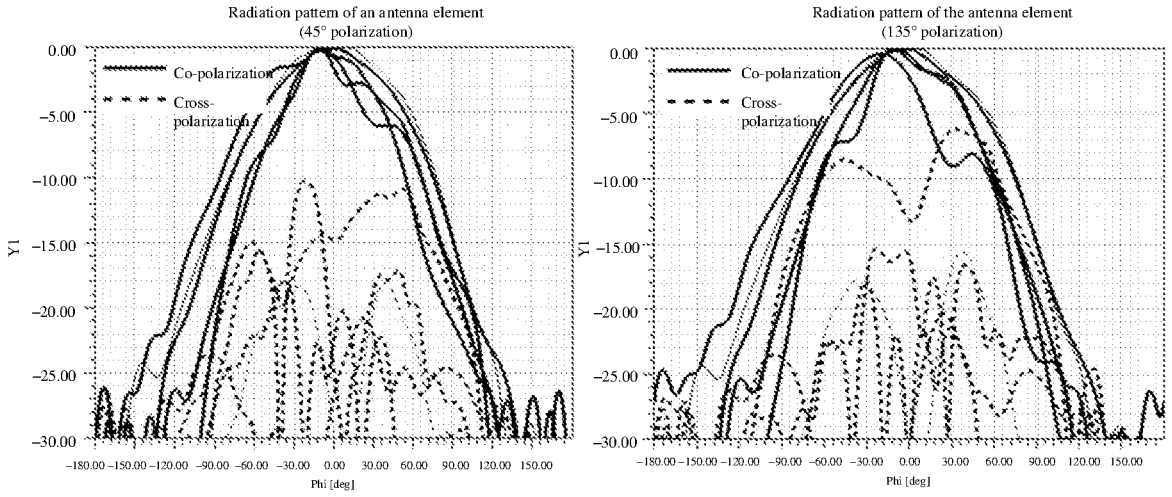
FIG. 1D is another schematic diagram of radiation patterns of an antenna element whose operating frequency band is 1.7 GHz to 2.7 GHz according to the prior art.

As shown in FIG. 1C and FIG. 1D, after an antenna element whose operating frequency band is 0.7 GHz to 0.9 GHz is added, problems such as polarization suppression ratio deterioration (a cross-polarization radiation increase shown by dashed lines) and a gain drop occur, at some frequencies, in a radiation pattern of an antenna element whose operating frequency band is 1.7 GHz to 2.7 GHz. To resolve the technical problems, this application provides a multi-band antenna structure.

In this application, adding a parasitic structure of an antenna element is considered to resolve the problems such as polarization suppression ratio deterioration and a gain drop that occur in a radiation pattern of the antenna element. However, if a parasitic structure is added only to an existing antenna structure, deterioration effects may be exerted on a radiation pattern of an antenna element with another frequency bands while a radiation pattern of an antenna element with a specific frequency band is optimized. The deterioration effects exerted by the parasitic structure on the radiation pattern of the antenna element with the another frequency bands are quite similar to side effects of anticancer drugs. The drugs inevitably harm normal histiocytes while killing cancer cells, and the drugs lose use value when the side effects take effect to some extent. Therefore, researching use of drugs that have "targeting" effects is crucial to improving curative effects.

Based on the foregoing line of thought, a main idea of this application is that if a parasitic structure with a "targeting" optimization function can be introduced, a problem of deterioration in a radiation pattern of an antenna element with another frequency bands can be resolved. Such a "targeting" parasitic structure has a current adjustment function only for an antenna element that is with a specific frequency band and that is expected to be optimized, but has no function for an antenna element with another frequency bands. In this case, the parasitic structure can be designed for the frequency band for which optimization needs to be performed, and the parasitic structure does not affect the surrounding antenna element with the another frequency bands after being added to the antenna structure.

Figure 2A:
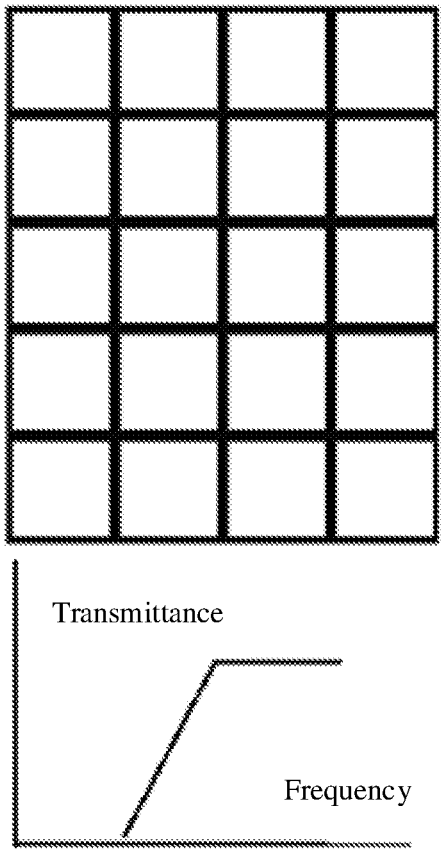
FIG. 2A is a schematic diagram of a high-pass FSS and transmittance of the FSS at different frequencies according to an embodiment of this application.
Figure 2B:
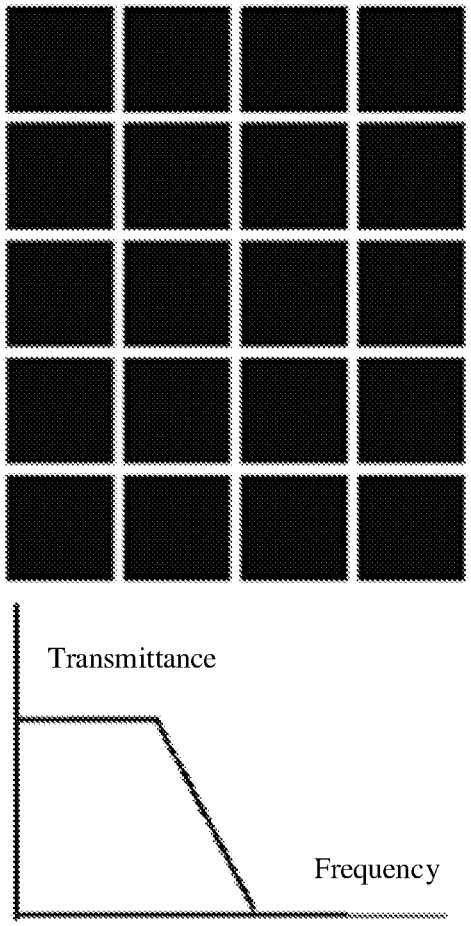
FIG. 2B is a schematic diagram of a low-pass FSS and transmittance of the FSS at different frequencies according to an embodiment of this application.
Figure 2C:
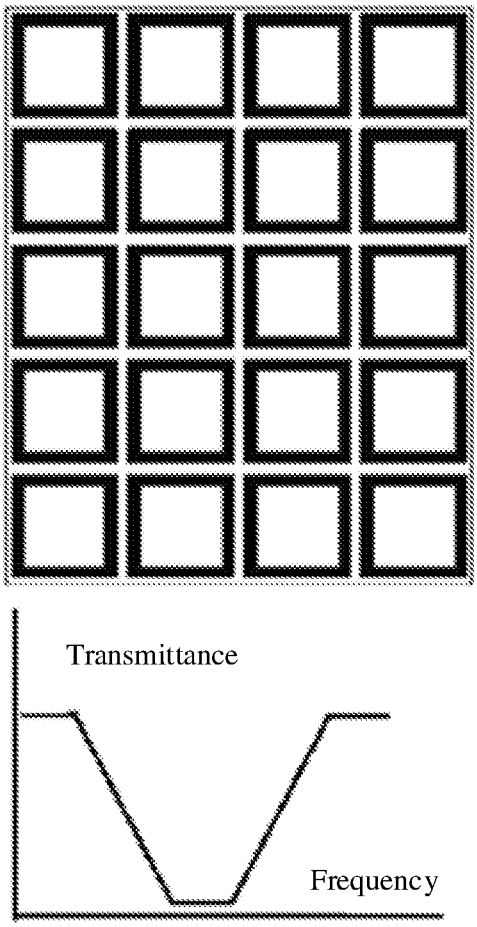
FIG. 2C is a schematic diagram of a band-pass FSS and transmittance of the FSS at different frequencies according to an embodiment of this application.
Figure 2D:
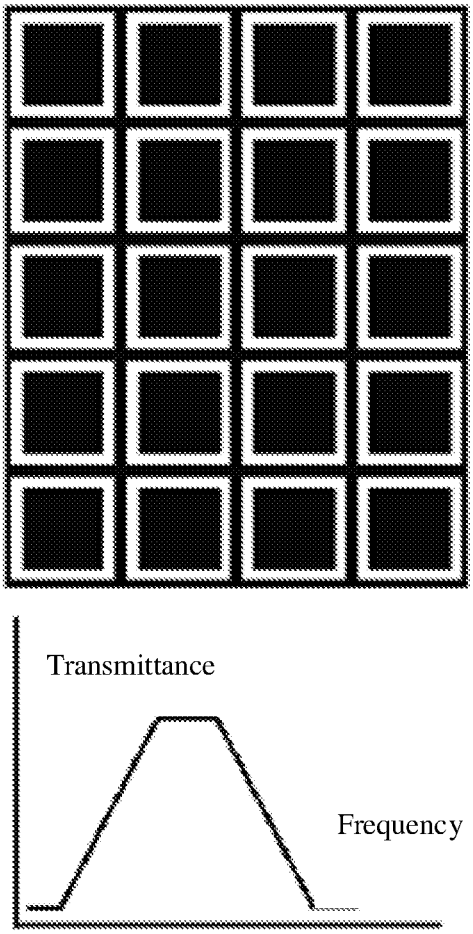
FIG. 2D is a schematic diagram of a band-stop FSS and transmittance of the FSS at different frequencies according to an embodiment of this application.

In this application, the parasitic structure with the "targeting" optimization function is implemented by using a frequency selective surface (FSS). The FSS is a planar structure including a single-layer or multi-layer periodically arranged conductive pattern. FSSs have a spatial electromagnetic wave filtering function. Based on spatial filtering characteristics of the FSSs, the FSSs are usually classified into a high-pass FSS, a low-pass FSS, a band-pass FSS, a band-stop FSS, and the like. FIG. 2A is a schematic diagram of a high-pass FSS and transmittance of the FSS at different frequencies according to an embodiment of this application. FIG. 2B is a schematic diagram of a low-pass FSS and transmittance of the FSS at different frequencies according to an embodiment of this application. FIG. 2C is a schematic diagram of a band-pass FSS and transmittance of the FSS at different frequencies according to an embodiment of this application. FIG. 2D is a schematic diagram of a band-stop FSS and transmittance of the FSS at different frequencies according to an embodiment of this application.

By utilizing a spatial filtering function of the FSS, the parasitic structure is designed by using the FSS, to implement a desired "targeting" optimization function. By researching passband and stopband characteristics of the FSS, it is found that in a passband, transmittance of the FSS is close to 100%, reflectivity of the FSS is close to 0, and a transmitted-signal phase shift is close to 0 degrees. In this case, it indicates that the FSS does not have any modulation effect on a signal at a passband frequency and can be equivalent to a vacuum. In a stopband range, transmittance of the FSS is close to 0, reflectivity of the FSS is close to 100%, and a reflected-signal phase shift is close to 180 degrees. In this case, an effect of the FSS approximates to that of a continuous conducting plane, and it indicates that the FSS can be equivalent to a continuous metal surface in the stopband range. According to the foregoing results, the passband and stopband characteristics of the FSS are properly utilized, so that the parasitic structure is equivalent to a continuous metal conductor in the frequency band for which optimization is expected to be performed, and is equivalent to a vacuum in the frequency band that is not expected to be affected. This can implement the desired "targeting" optimization function.

Specifically, an FSS plane is first designed. The FSS plane includes at least one FSS cell. The FSS plane has a stopband characteristic for a frequency band that is of the antenna structure and for which optimization needs to be performed, reflectivity of the FSS plane relative to a stopband electromagnetic wave is greater than 60%, and a reflection phase shift ranges from 135 degrees to 225 degrees. The FSS plane has a passband characteristic for an antenna element with another frequency bands in the antenna structure, transmittance of the FSS plane relative to a passband electromagnetic wave is greater than 60%, and a transmission phase shift ranges from −45 degrees to 45 degrees. It should be noted that the antenna structure described in this application may be a shared-aperture antenna array, or may not be a shared-aperture antenna array. This is not limited in this application.

Then, a parasitic structure is designed by using the FSS plane. In other words, the parasitic structure includes one or more FSS planes. The parasitic structure may be an enclosure frame, an isolation bar, a baffle plate, a parasitic patch, or the like. A specific structure of the parasitic structure is not limited in this application. When an electromagnetic wave generated by an antenna element with a frequency band for which optimization is expected to be optimized is incident on the parasitic structure, because the parasitic structure includes the FSS plane and the FSS plane has a stopband characteristic for the antenna element, a function of the FSS plane is equivalent to a continuous metal surface, and the electromagnetic wave generated by the antenna element is reflected. In this way, a near-field current is adjusted, thereby achieving a desired far-field radiation pattern optimization effect. In contrast, when an electromagnetic wave generated by an antenna element with another frequency bands is incident on the parasitic structure, because the FSS plane has a passband characteristic for the antenna element, reflection of the electromagnetic wave is quite weak, a near-field current is not greatly adjusted, and a far-field radiation pattern remains unchanged basically. By using the parasitic structure including the FSS plane, radiation patterns of an antenna element and an array that need to be optimized are selected based on a frequency, while radiation patterns of other antenna elements and arrays in adjacent space are not significantly affected. In this way, the desired "targeting" optimization function is implemented.

Based on the foregoing main idea, the following details the multi-band antenna structure provided in this application.

Figure 3A:
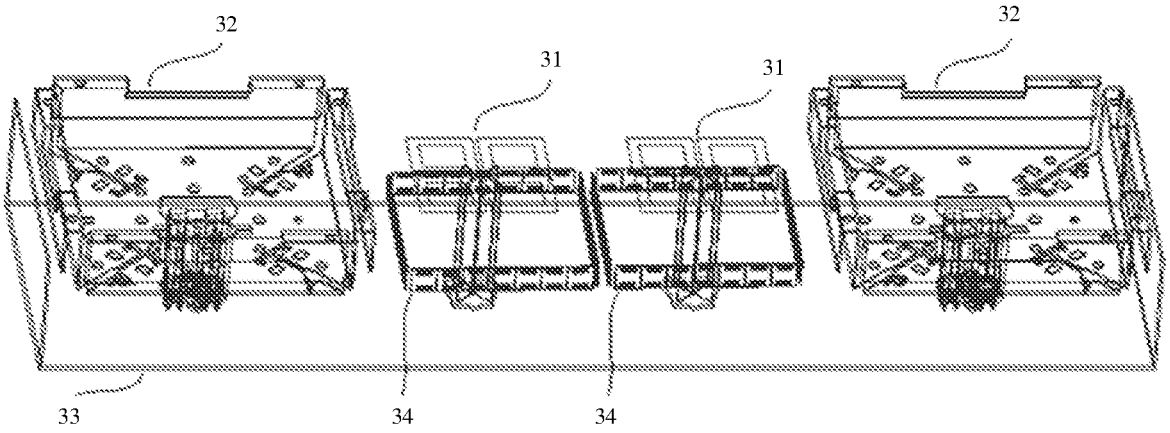
FIG. 3A is a schematic diagram of a multi-band antenna structure according to an embodiment of this application.

FIG. 3A is a schematic diagram of a multi-band antenna structure according to an embodiment of this application. As shown in FIG. 3A, the multi-band antenna structure includes a first antenna element 31, a second antenna element 32, a reflection panel 33, and a first parasitic structure 34 of the first antenna element 31.

The first antenna element 31, the second antenna element 32, and the first parasitic structure 34 are disposed above the reflection panel 33. The first antenna element 31, the second antenna element 32, and the first parasitic structure 34 may have or may not have an electrical connection relationship with the reflection panel 33. This is not limited in this application.

The first antenna element 31 and the second antenna element 32 are adjacent to each other, and a distance between the first antenna element 31 and the second antenna element 32 is less than 0.5 times a vacuum wavelength corresponding to the lower of operating frequency bands of the first antenna element 31 and the second antenna element 32. For example, a spacing between the first antenna element 31 and the second antenna element 32 that are adjacent to each other is 100 mm. A distance between the first antenna element 31 and the first parasitic structure 34 is less than 0.5 times a vacuum wavelength corresponding to an operating frequency band of the first antenna element 31, and a distance between the second antenna element 32 and the first parasitic structure 34 is less than 0.5 times a vacuum wavelength corresponding to an operating frequency band of the second antenna element 32. In other words, the first parasitic structure 34 provided in this application is applicable to a near-field region.

It should be noted that the operating frequency bands of the first antenna element 31 and the second antenna element 32 are different. For example, the operating frequency band of the first antenna element 31 is 1.7 GHz to 2.7 GHz, and the operating frequency band of the second antenna element 32 is 0.7 GHz to 0.9 GHz. Alternatively, the operating frequency band of the first antenna element is 0.7 GHz to 0.9 GHz, and the operating frequency band of the second antenna element is 1.7 GHz to 2.7 GHz. A distance between the reflection panel 33 and an antenna element with a higher operating frequency band in the first antenna element 31 and the second antenna element 32 is less than a distance between the reflection panel 33 and an antenna element with a lower operating frequency band. For example, the operating frequency band of the first antenna element is 1.7 GHz to 2.7 GHz, and the operating frequency band of the second antenna element is 0.7 GHz to 0.9 GHz. In this case, a distance between the first antenna element and the reflection panel is less than a distance between the second antenna element and the reflection panel.

Optionally, when the first parasitic structure 34 includes a plurality of FSS planes, structures of the FSS planes are identical or different. Optionally, the FSS plane is disposed between a top of the first antenna element and the reflection panel, and an included angle between the FSS plane and the reflection panel is greater than 30 degrees. For example, an included angle between the first antenna element and the reflection panel is 90 degrees, or an included angle between the first antenna element and the reflection panel is 45 degrees.

Figure 3B:
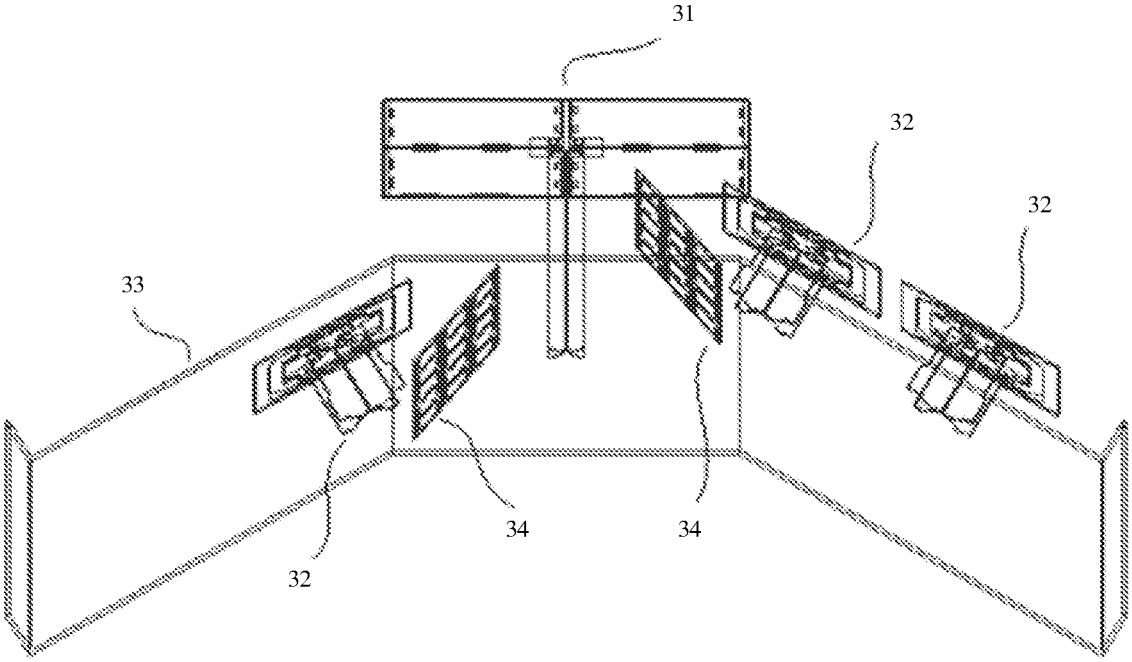
FIG. 3B is a schematic diagram of a multi-band antenna structure according to another embodiment of this application.
Figure 3C:
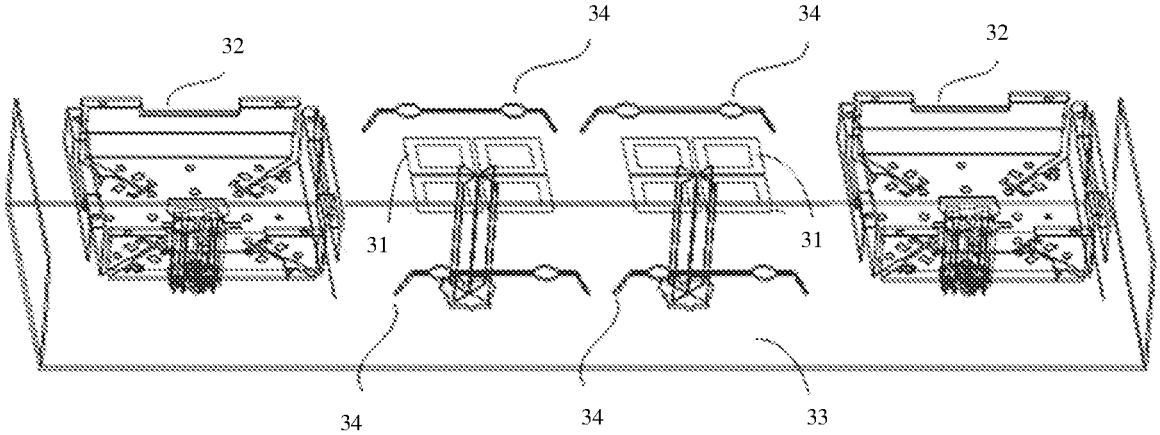
FIG. 3C is a schematic diagram of a multi-band antenna structure according to still another embodiment of this application.
Figure 3D:
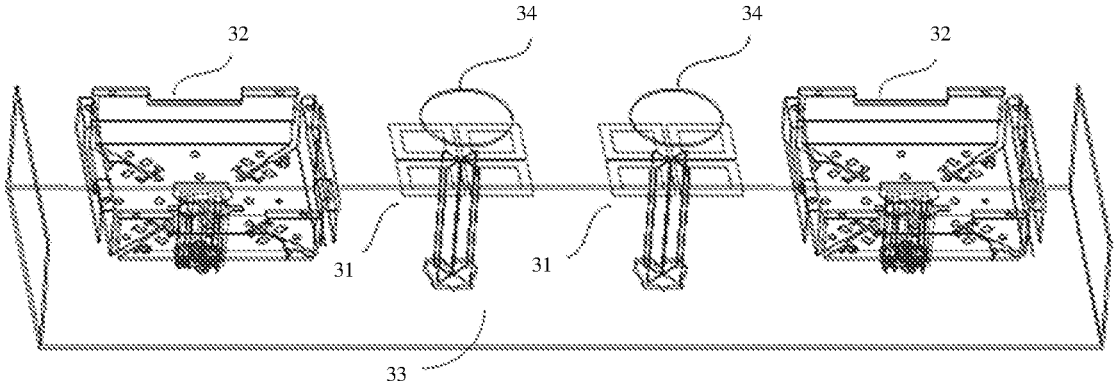
FIG. 3D is a schematic diagram of a multi-band antenna structure according to yet another embodiment of this application.

The first parasitic structure may be an enclosure frame, an isolation bar, a baffle plate, a parasitic patch, or the like. For example, as shown in FIG. 3A, the first parasitic structure is an enclosure frame. FIG. 3B is a schematic diagram of a multi-band antenna structure according to another embodiment of this application. As shown in FIG. 3B, the first parasitic structure 34 is a baffle plate including an FSS, and the baffle plate may also be referred to as an FSS baffle plate. FIG. 3C is a schematic diagram of a multi-band antenna structure according to still another embodiment of this application. As shown in FIG. 3C, the first parasitic structure 34 is an isolation bar including an FSS, and the isolation bar may also be referred to as an FSS isolation bar. FIG. 3D is a schematic diagram of a multi-band antenna structure according to yet another embodiment of this application. As shown in FIG. 3D, the first parasitic structure 34 is a parasitic patch including an FSS, and the parasitic patch may also be referred to as an FSS parasitic patch.

Regardless of whether the first parasitic structure 34 is an enclosure frame, an isolation bar, a baffle plate, a parasitic patch, or any other structure, the first parasitic structure 34 has a stopband characteristic for the first antenna element 31 and has a passband characteristic for the second antenna element 32. As described above, optionally, that the first parasitic structure 34 has a stopband characteristic for the first antenna element 31 means that reflectivity of the first parasitic structure 34 relative to the first antenna element 31 is greater than 60% and a reflection phase shift ranges from 135 degrees to 225 degrees. That the first parasitic structure 34 has a passband characteristic for the second antenna element 32 means that transmittance of the first parasitic structure relative to the second antenna element is greater than 60% and a transmission phase shift ranges from −45 degrees to 45 degrees. Certainly, no limitation is imposed on the foregoing values "60%", "135 degrees", "225 degrees", "−45 degrees", and "45 degrees". For example, "60%" may be replaced with "70%".

In a possible design, the multi-band antenna structure includes at least one first antenna element 31. The "at least one" includes one or more. For example, as shown in FIG. 3A, FIG. 3C, and FIG. 3D, the multi-band antenna structure includes two first antenna elements 31, and the two first antenna elements 31 form an antenna array of a specific operating frequency band. For another example, as shown in FIG. 3B, the multi-band antenna structure includes one first antenna element 31. As shown in FIG. 3A, FIG. 3C, and FIG. 3D, a center-to-center spacing between the two first antenna elements 31 may be but is not limited to 80 mm.

In a possible design, the multi-band antenna structure includes at least one second antenna element 32. Likewise, the "at least one" includes one or more. For example, as shown in FIG. 3A, FIG. 3C, and FIG. 3D, the multi-band antenna structure includes two second antenna elements 32, and the two second antenna elements 32 form an antenna array of another operating frequency band. For another example, as shown in FIG. 3B, the multi-band antenna structure includes three second antenna elements 32.

In a possible design, when the multi-band antenna structure includes a plurality of first antenna elements 31, the multi-band antenna structure also includes a plurality of first parasitic structures 34. The plurality of first antenna elements 31 are in a one-to-one correspondence with the plurality of first parasitic structures 34. Optionally, distances between the first antenna elements 31 and the corresponding first parasitic structures 34 are the same.

In another possible design, when the multi-band antenna structure includes a plurality of first antenna elements 31, the multi-band antenna structure also includes at least one first parasitic structure 34. Some of the plurality of first antenna elements 31 are in a one-to-one correspondence with the at least one first parasitic structure 34, and the rest of the plurality of first antenna elements 31 has no corresponding first parasitic structure 34.

In summary, according to the multi-band antenna structure provided in this application, the antenna structure includes the first antenna element, the second antenna element, the reflection panel, and the first parasitic structure of the first antenna element. The operating frequency bands of the first antenna element and the second antenna element are different, and the distance between the reflection panel and the antenna element with the higher operating frequency band in the first antenna element and the second antenna element is less than the distance between the reflection panel and the antenna element with the lower operating frequency band in the first antenna element and the second antenna element. The first antenna element and the second antenna element are adjacent to each other, and the distance between the first antenna element and the second antenna element is less than 0.5 times the vacuum wavelength corresponding to the lower of the operating frequency bands of the first antenna element and the second antenna element. The distance between the first antenna element and the first parasitic structure is less than 0.5 times the vacuum wavelength corresponding to the operating frequency band of the first antenna element. The distance between the second antenna element and the first parasitic structure is less than 0.5 times the vacuum wavelength corresponding to the operating frequency band of the second antenna element. It can be learnt that the first parasitic structure is applicable to the near-field region. Further, the first parasitic structure includes one or more FSS planes, and the first parasitic structure has the stopband characteristic for the first antenna element and has the passband characteristic for the second antenna element. Therefore, the first parasitic structure is equivalent to a continuous metal conductor in the operating frequency band of the first antenna element, and is equivalent to a vacuum in the operating frequency band of the second antenna element. This can implement a desired "targeting" optimization function. In this way, problems such as polarization suppression ratio deterioration and a gain drop that occur, at some frequencies, in a radiation pattern of the first antenna element can be resolved, and performance of the second antenna element is not markedly affected.

Figure 4:
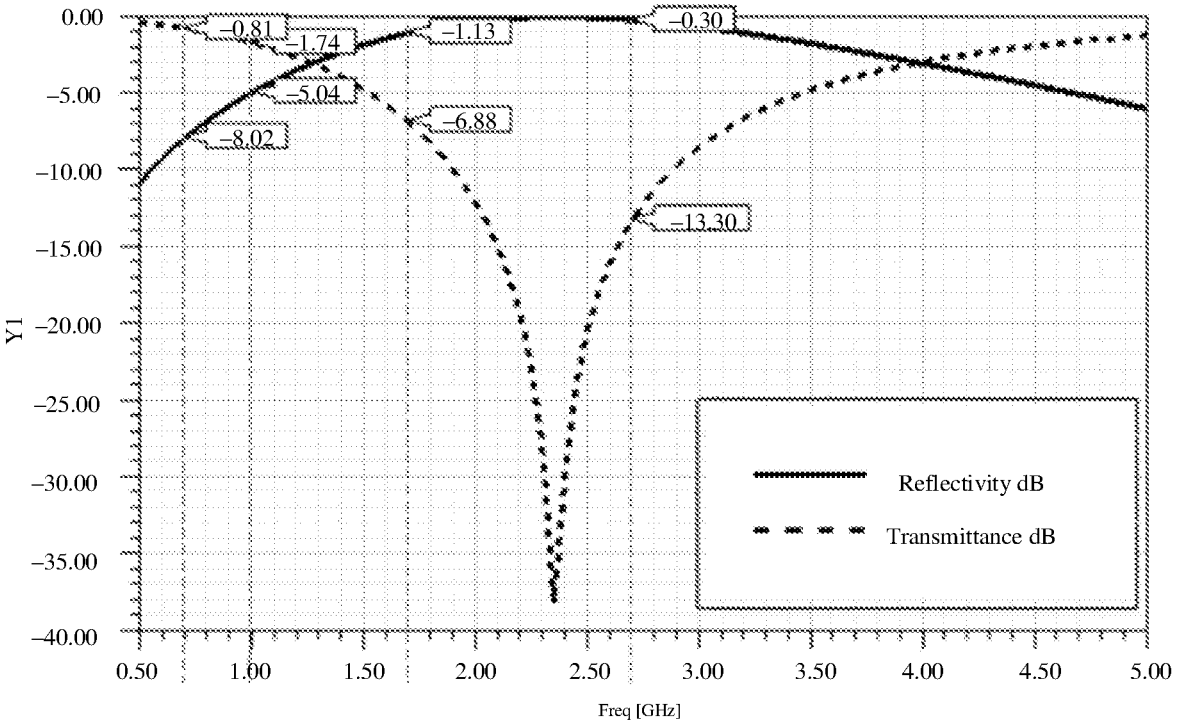
FIG. 4 is a schematic diagram of a frequency response characteristic, relative to a spatial electromagnetic wave, of a large planar array formed by evenly arranging FSS cells according to an embodiment of this application.
Figure 5A:
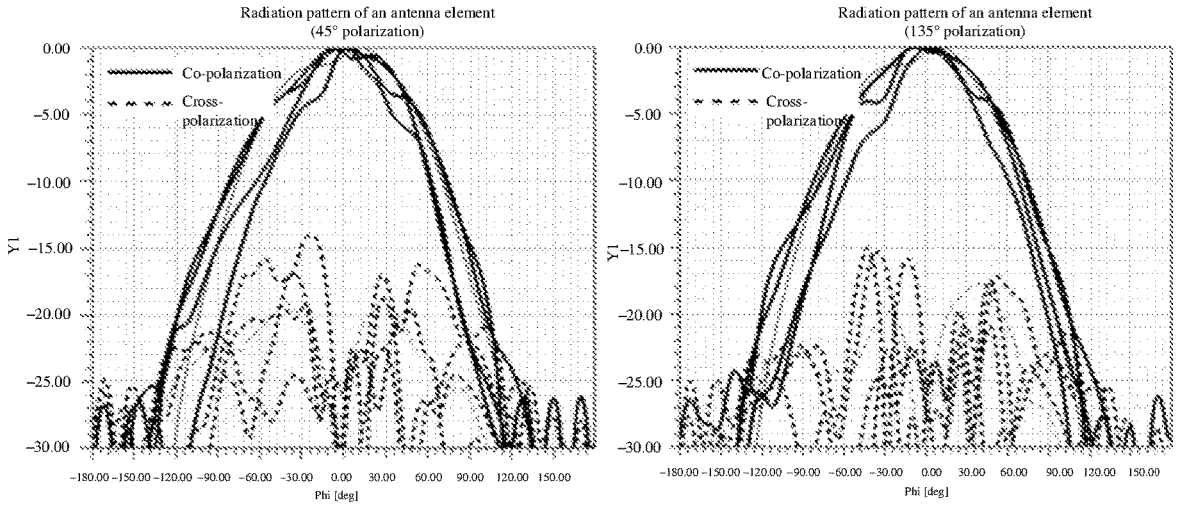
FIG. 5A is radiation patterns of a first antenna element according to an embodiment of this application.
Figure 5B:
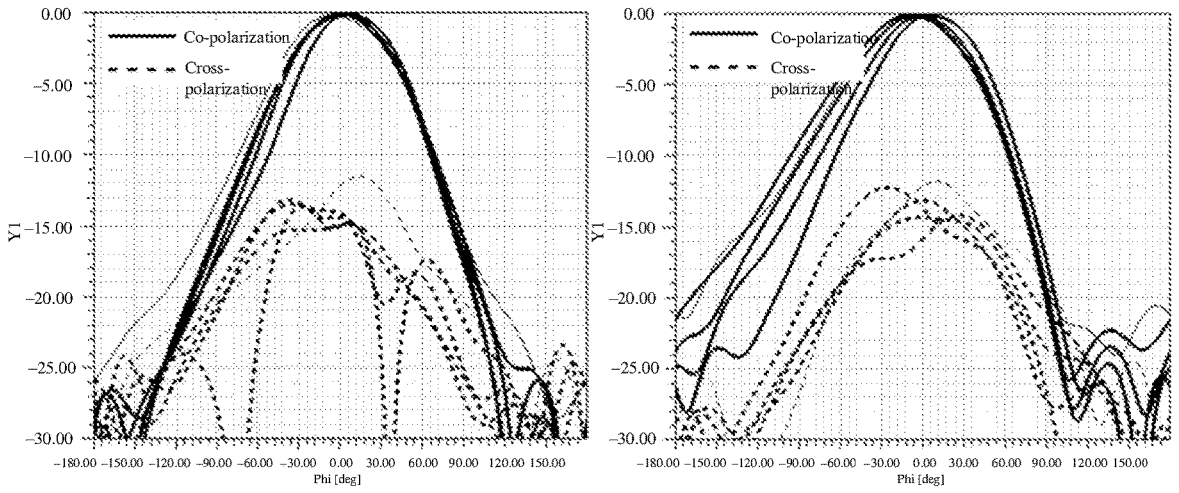
FIG. 5B is radiation patterns of a second antenna element according to an embodiment of this application.

In a possible design, the FSS plane is formed by evenly arranging a plurality of FSS cells. The FSS cells have a stopband characteristic for the first antenna element and have a passband characteristic for the second antenna element. A frequency response characteristic, relative to a spatial electromagnetic wave, of a large planar array formed by evenly arranging the FSS cells can be simulated by using commercial 3D electromagnetic simulation software HFSS. FIG. 4 is a schematic diagram of a frequency response characteristic, relative to a spatial electromagnetic wave, of a large planar array formed by evenly arranging FSS cells according to an embodiment of this application. As shown in FIG. 4, the plane formed by evenly arranging the FSS cells has a quite strong reflection effect on an electromagnetic wave generated by the first antenna element, where a proportion of energy occupied by a reflected signal is greater than 70%, and a proportion of energy occupied by a transmitted signal is less than 30%. In addition, the plane formed by evenly arranging the FSS cells has relatively low reflectivity relative to an electromagnetic wave generated by the second antenna element, where a proportion of energy occupied by a reflected signal is less than 30%, and a proportion of energy occupied by a transmitted signal is greater than 70%. It is assumed that the plurality of FSS cells are evenly arranged to form an FSS plane, four FSS planes are disposed in an enclosure manner to form an enclosure frame, and the enclosure frame is used as the first antenna element. FIG. 5A is radiation patterns of a first antenna element according to an embodiment of this application, and FIG. 5B is radiation patterns of a second antenna element according to an embodiment of this application. It can be learnt from FIG. 5A and FIG. 5B that, the enclosure frame formed by the FSS cells has an optimization effect on the radiation pattern of the first antenna element, but hardly affects the radiation pattern of the second antenna element. In this way, the desired "targeting" optimization function is implemented.

Figure 6:
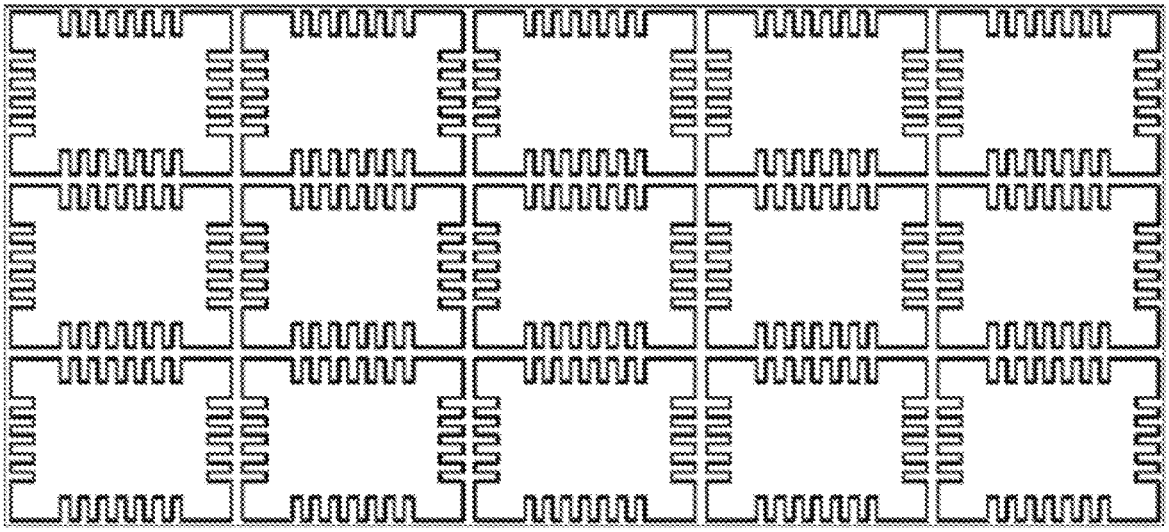
FIG. 6 is a schematic diagram of an FSS baffle plate according to an embodiment of this application.
Figure 7A:
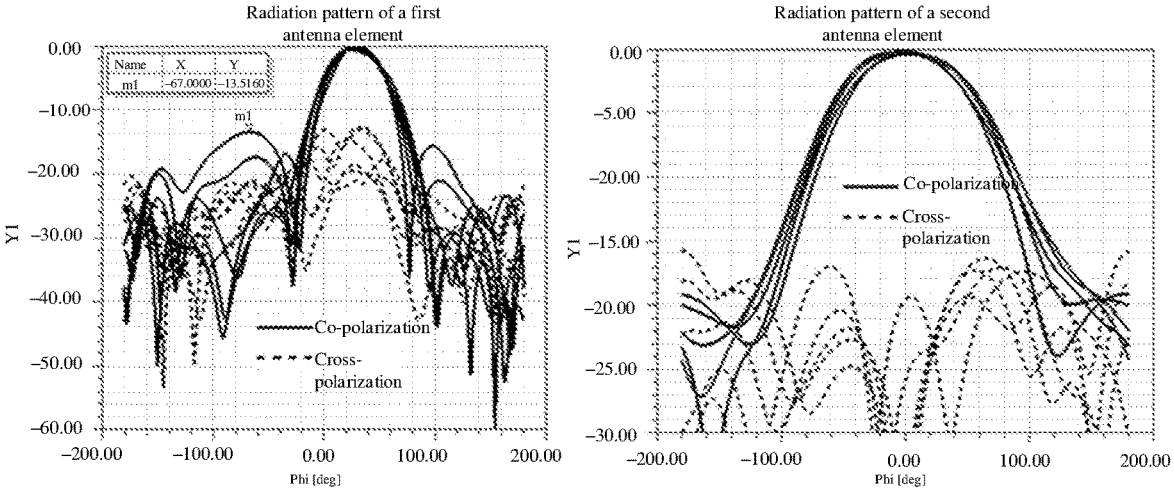
FIG. 7A is radiation patterns of a first antenna element and a second antenna element when no baffle plate is used according to an embodiment of this application.
Figure 7B:
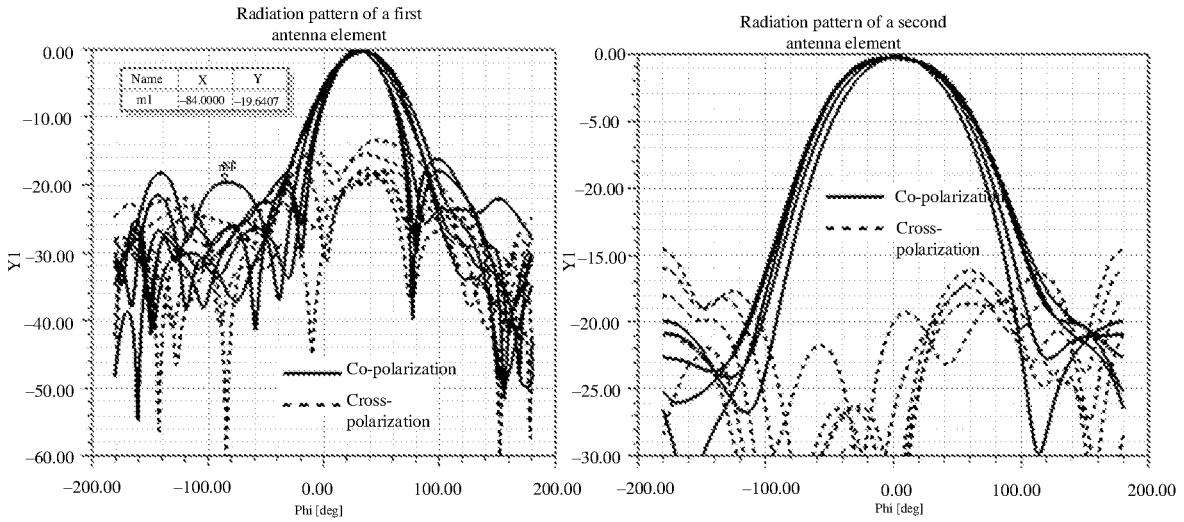
FIG. 7B is radiation patterns of a first antenna element and a second antenna element when a baffle plate is used according to an embodiment of this application.

Likewise, the plurality of FSS cells may alternatively form a baffle plate. FIG. 6 is a schematic diagram of an FSS baffle plate according to an embodiment of this application. The baffle plate may be configured to improve side-lobe suppression performance of the first antenna element in a −70 degree direction. The baffle plate is placed at a 45-degree angle with a part that is of the reflection panel and on which the first antenna element is located. FIG. 7A is radiation patterns of a first antenna element and a second antenna element when no baffle plate is used according to an embodiment of this application. As shown in FIG. 7A, a figure on the left is the radiation pattern of the first antenna element, and a figure on the right is the radiation pattern of the second antenna element. As shown in FIG. 7A, for the first antenna element, there is a relatively large side lobe near −70 degrees. FIG. 7B is radiation patterns of a first antenna element and a second antenna element when a baffle plate is used according to an embodiment of this application. As shown in FIG. 7B, a figure on the left is the radiation pattern of the first antenna element, and a figure on the right is the radiation pattern of the second antenna element. As shown in FIG. 7B, a side lobe of the first antenna element is improved, and no obvious performance deterioration occurs in the radiation pattern of the second antenna element. It can be learnt that the baffle plate can achieve a required "targeting" optimization effect.

Figure 8:
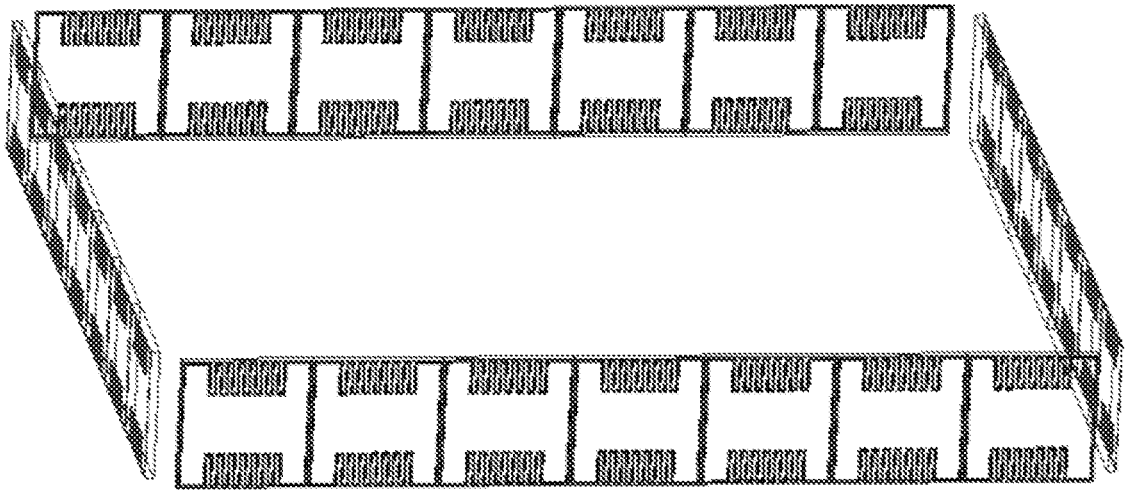
FIG. 8 is a schematic diagram of an enclosure frame according to an embodiment of this application.

It should be noted that, an overall size of a parasitic structure used to optimize a radiation pattern is usually required to be relatively small, and therefore a small-sized structure needs to be selected for an FSS cell that forms the parasitic structure. In this way, a plurality of FSS cells can be evenly arranged in a limited size range to form a macroscopic effect of a local reflective surface or transmission surface. For example, in a possible design, for the first parasitic structure, when a shape of the FSS cell that forms the first parasitic structure is rectangular, a maximum side length of the FSS cell is less than 0.2 times a maximum vacuum wavelength of the first antenna element. When a shape of the FSS cell that forms the first parasitic structure is circular, a diameter of the FSS cell is less than 0.2 times a maximum vacuum wavelength of the first antenna element. In a possible design, an area of the FSS plane is less than a 1-square vacuum wavelength of the first antenna element. For example, FIG. 8 is a schematic diagram of an enclosure frame according to an embodiment of this application. As shown in FIG. 8, the enclosure frame is formed by disposing four FSS planes (where each FSS plane is in a rectangle shape) in an enclosure manner. Optionally, a size of a single FSS plane is 70 mm×10 mm, a vacuum wavelength corresponding to the operating frequency band of the first antenna element is 0.5×0.07 wavelength, and a size of a single FSS cell is 0.07×0.07 wavelength or may be 10 mm×10 mm. Herein, the size of the FSS cell is far less than a size of an FSS plane in the prior art.

Figure 9A:
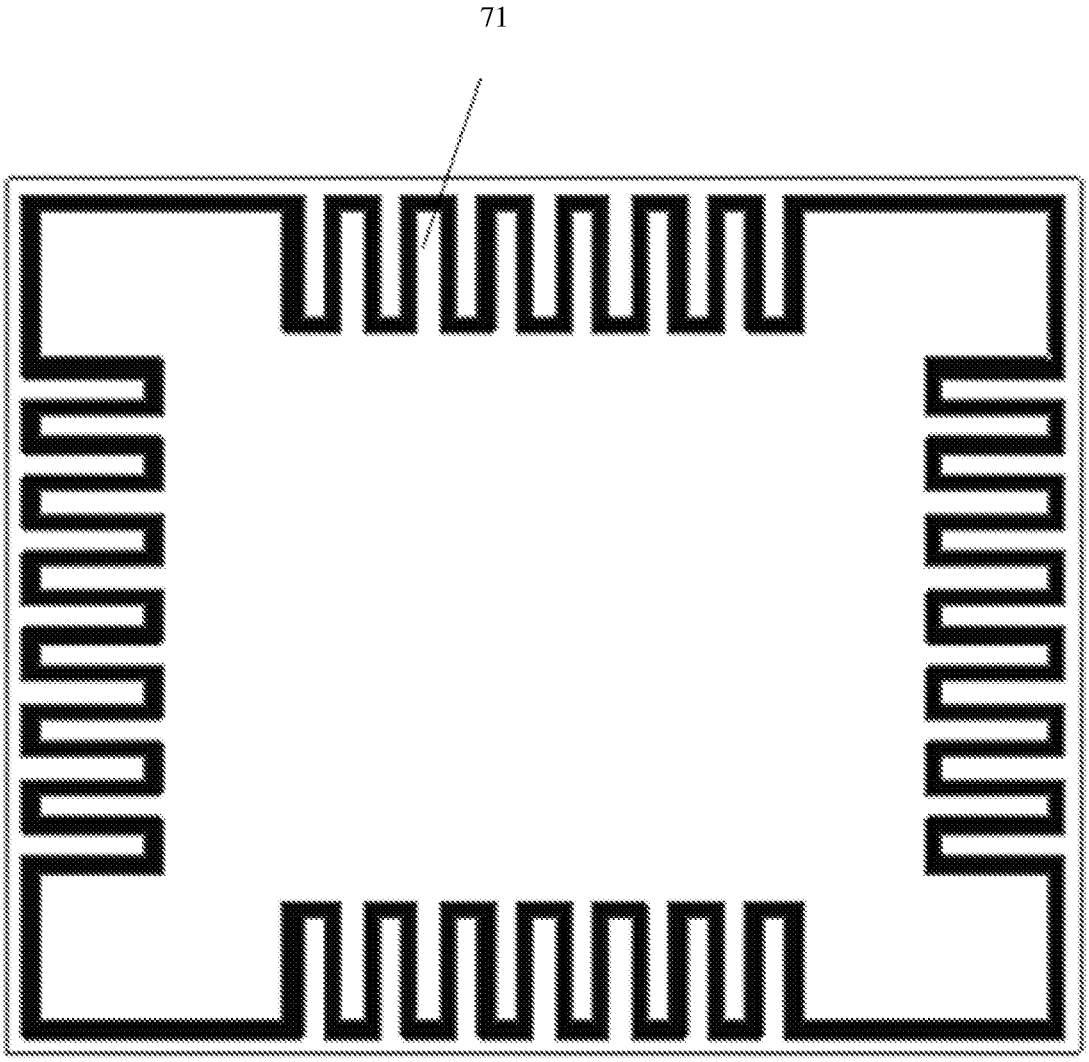
FIG. 9A and FIG. 10A are schematic diagrams of closed annular conductor structures according to an embodiment of this application.
Figure 9B:
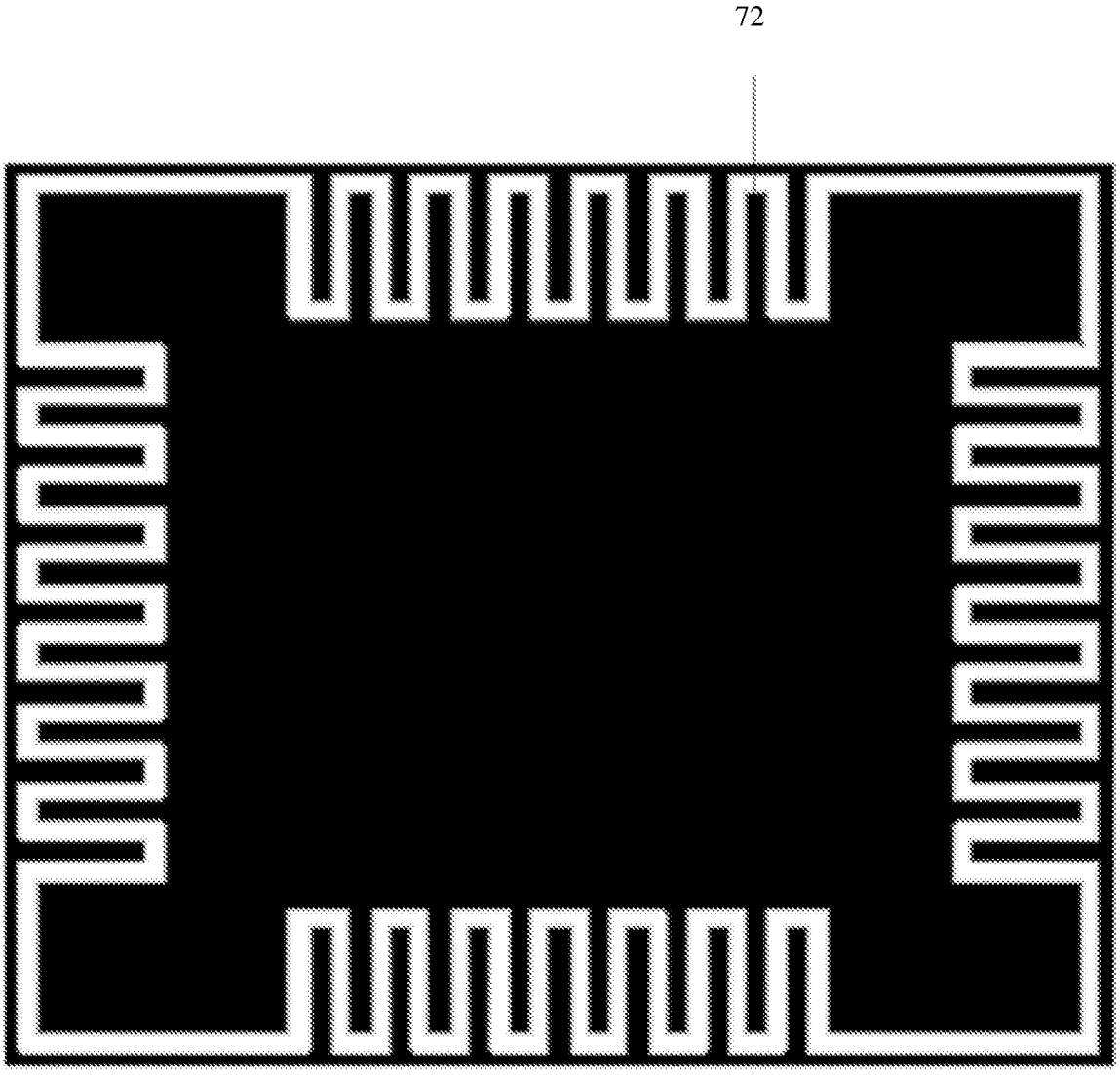
FIG. 9B and FIG. 10B are schematic diagrams of closed annular slotted structures according to an embodiment of this application.
Figure 10A:
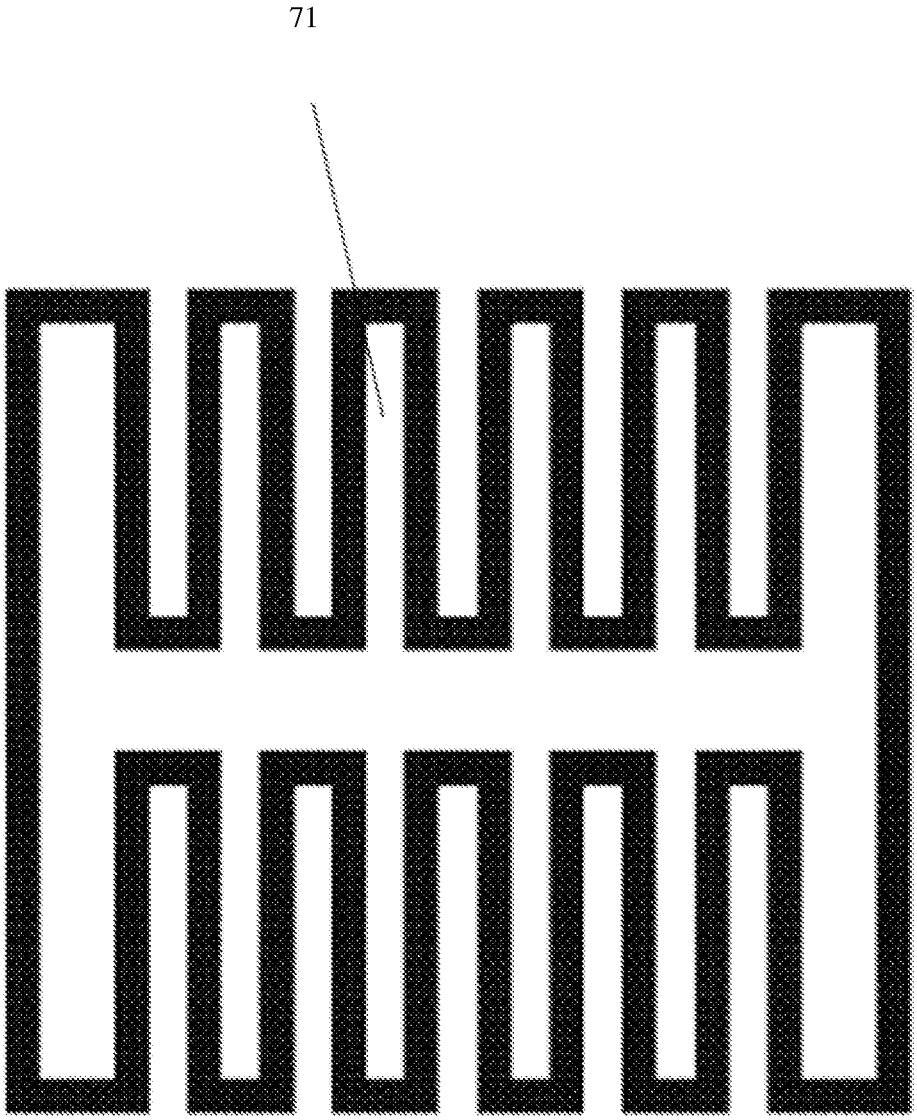
Figure 10B:
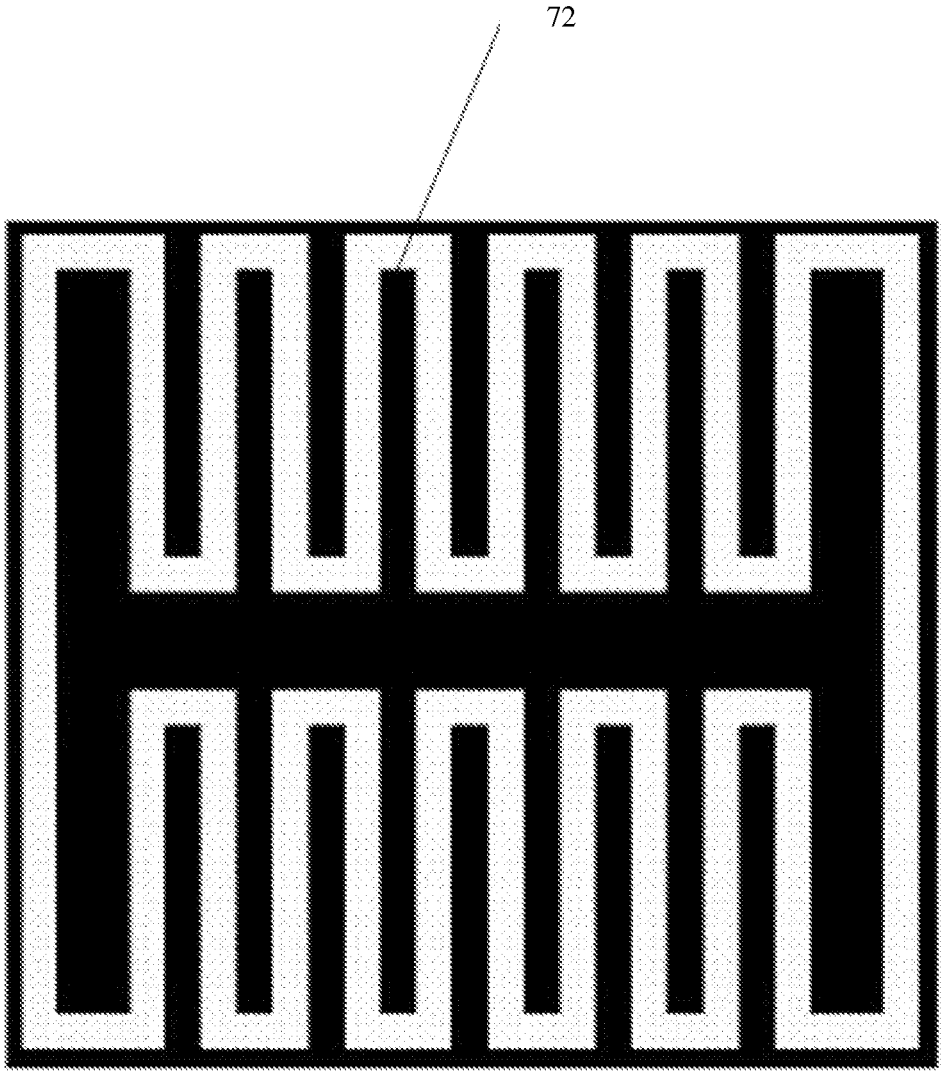

In a possible design, to implement a small-sized FSS cell, the FSS cell may be of a miniaturized closed annular conductor structure or a miniaturized closed annular slotted structure. For example, FIG. 9A and FIG. 10A are schematic diagrams of closed annular conductor structures according to an embodiment of this application. FIG. 9B and FIG. 10B are schematic diagrams of closed annular slotted structures according to an embodiment of this application. As shown in FIG. 9A and FIG. 10A, optionally, the miniaturized closed annular conductor structure means that the structure includes a bent winding pattern structure. Optionally, a minimum width of a conductor strip in the bent winding pattern structure is less than 0.02 times the maximum vacuum wavelength of the first antenna element. As shown in FIG. 9A and FIG. 10A, 71 represents conductor strips. Assuming that widths of the conductor strips in the bent winding pattern structure are the same, a wideband of each conductor strip is less than 0.02 times the maximum vacuum wavelength of the first antenna element. As shown in FIG. 9B and FIG. 10B, optionally, the closed annular slotted structure means that the closed annular slotted structure includes a bent winding pattern structure. Optionally, a minimum width of a slotted strip in the bent winding pattern structure is less than 0.02 times the maximum vacuum wavelength of the first antenna element. As shown in FIG. 9B and FIG. 10B, 72 represents slotted strips. Assuming that widths of the slotted strips in the bent winding pattern structure are the same, a wideband of each slotted strip is less than 0.02 times the maximum vacuum wavelength of the first antenna element. It should be noted that in FIG. 9A, FIG. 9B, FIG. 10A, and FIG. 10B, black parts represent conductors, and white pails represent hollows.

In a possible design, in addition to a miniaturization characteristic, the FSS cell may also have a non-rotational symmetry characteristic. The reasons for using a non-rotationally symmetric structure for the FSS cell are as follows.

First, using the non-rotationally symmetric structure can better satisfy an overall external dimension of a parasitic structure. Because the overall size of the parasitic structure is relatively small, if the FSS cell uses a rotationally symmetric structure, it is quite difficult to make arrangement of the FSS cell exactly satisfy a size requirement of an antenna element in two directions.

Second, a conventional FSS plane is applied to a far-field region, and a distance between the FSS plane and an antenna element is relatively long. The distance between the FSS plane and the antenna element is usually greater than a ½ vacuum wavelength. In addition, the FSS plane is a large-area plane formed by a relatively large quantity of FSS cells, the quantity of included FSS cells is usually greater than 100, and an area of the plane formed by the FSS plane is greater than a 1-square vacuum wavelength. In this case, a rotationally symmetric structure can be used to ensure that when electromagnetic waves with different directions and different polarization are incident on the FSS plane, a stable frequency response (a frequency selection characteristic) can be maintained. In contrast, in this application, a used FSS plane is an FSS plane with a relatively small size formed by a small quantity of miniaturized FSS cells, the quantity of FSS cells included in the FSS plane is usually less than 100, an area of the FSS plane is usually less than a 1-square vacuum wavelength, and a distance between the FSS plane and an antenna element is less than a ½ vacuum wavelength. The antenna element may be a to-be-optimized antenna element (such as the first antenna element) or an antenna element that is not expected to be affected (such as the second antenna element). In this case, for electromagnetic waves generated by different antenna elements, electromagnetic waves that are incident on the FSS plane have only a specific angle and polarization direction. Therefore, original meaning of using the rotationally symmetric structure is lost, instead, use of a non-rotationally symmetric structure can achieve better passband and stopband effects in a specific environment.

Figure 11:
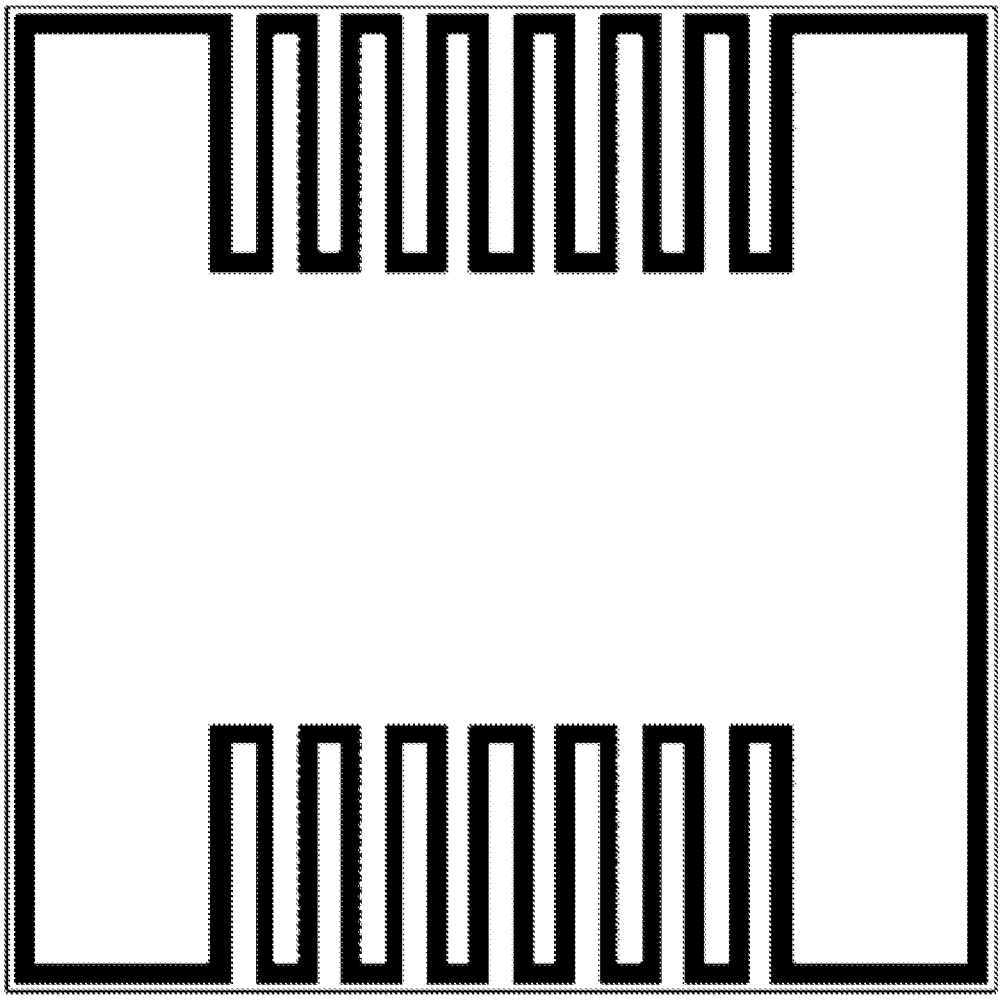
FIG. 11 is a schematic diagram of a non-rotationally symmetric FSS cell according to an embodiment of this application.
Figure 12:
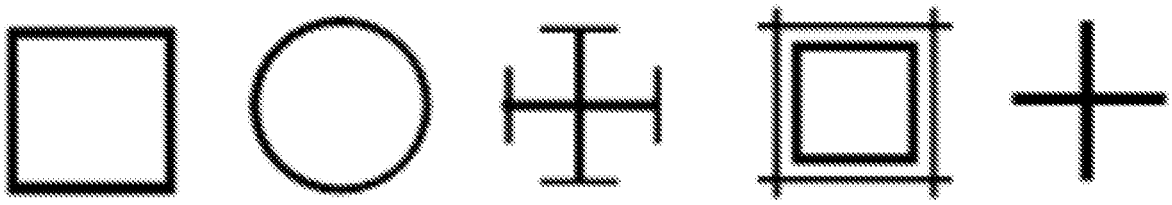
FIG. 12 is a schematic diagram of a plurality of rotationally symmetric FSS cells according to an embodiment of this application.

Using the non-rotationally symmetric structure for the FSS cell specifically includes a shape (also referred to as an outline) of the FSS cell is not a regular polygon or a circular shape. Alternatively, an outline of the FSS cell is a regular polygon or a circular shape, but different metal wire widths or different winding manners are used for different edges or arc segments. For example, FIG. 11 is a schematic diagram of a non-rotationally symmetric FSS cell according to an embodiment of this application. Certainly, in this application, the FSS cell is not limited to the non-rotationally symmetric structure, and the FSS cell may alternatively be a rotationally symmetric structure. For example, FIG. 12 is a schematic diagram of a plurality of rotationally symmetric FSS cells according to an embodiment of this application. As shown in FIG. 12, shapes of the rotationally symmetric FSS cells may be rectangular, circular, or the like.

In summary, in this application, the FSS plane may be formed by evenly arranging a plurality of FSS cells. This can better implement the desired "targeting" optimization function, so that the problems such as polarization suppression ratio deterioration and a gain drop that occur, at some frequencies, in the radiation pattern of the first antenna element can be resolved. Further, in this application, the FSS cell may be a miniaturized FSS cell. Therefore, "targeting" optimization can be performed on the radiation pattern of the first antenna element, and the radiation pattern of the second antenna element in adjacent space is not affected while the radiation pattern of the first antenna element is optimized. Furthermore, in this application, the FSS cell may use the non-rotationally symmetric structure, so that the first parasitic structure can be better applicable to the near-field region.

The multi-band antenna structure described above includes the first parasitic structure of the first antenna element. In addition, the multi-band antenna structure may further include a second parasitic structure of the second antenna element. The second parasitic structure is disposed above the reflection panel, the second parasitic structure includes one or more FSS planes, and the second parasitic structure has a passband characteristic for the first antenna element and has a stopband characteristic for the second antenna element, and a distance between the first antenna element and the second parasitic structure is less than 0.5 times the vacuum wavelength corresponding to the operating frequency band of the first antenna element, and a distance between the second antenna element and the second parasitic structure is less than 0.5 times the vacuum wavelength corresponding to the operating frequency band of the second antenna element.

In a possible design, reflectivity of the second parasitic structure relative to the second antenna element is greater than 60%, a reflection phase shift ranges from 135 degrees to 225 degrees, transmittance of the second parasitic structure relative to the first antenna element is greater than 60%, and a transmission phase shift ranges from −45 degrees to 45 degrees.

In a possible design, when the second parasitic structure includes a plurality of FSS planes, structures of the FSS planes are identical or different.

In a possible design, the FSS plane of the second parasitic structure is disposed between a top of the second antenna element and the reflection panel, and an included angle between the FSS plane and the reflection panel is greater than 30 degrees.

In a possible design, the FSS plane of the second parasitic structure is formed by evenly arranging a plurality of FSS cells.

In a possible design, the FSS cell of the second parasitic structure is of a closed annular conductor structure or a closed annular slotted structure.

In a possible design, the closed annular conductor structure includes a bent winding pattern structure, and the closed annular slotted structure includes a bent winding pattern structure.

In a possible design, a minimum width of a conductor strip or a slotted strip in the bent winding pattern structure is less than 0.02 times a maximum vacuum wavelength of the second antenna element.

In a possible design, the FSS cell that forms the second parasitic structure is of a non-rotationally symmetric structure.

In a possible design, a shape of the FSS cell that forms the second parasitic structure is rectangular or circular.

In a possible design, when the shape of the FSS cell that forms the second parasitic structure is rectangular, a maximum side length of the FSS cell is less than 0.2 times the maximum vacuum wavelength of the second antenna element, or when the shape of the FSS cell that forms the second parasitic structure is circular, a diameter of the FSS cell is less than 0.2 times the maximum vacuum wavelength of the second antenna element.

In a possible design, an area of the FSS plane of the second parasitic structure is less than a 1-square vacuum wavelength of the second antenna element.

In a possible design, the multi-band antenna structure includes a plurality of second parasitic structures and an antenna array that includes a plurality of second antenna elements, where the plurality of second antenna elements are in a one-to-one correspondence with the plurality of second parasitic structures, and distances between the second antenna elements and the corresponding second parasitic structures are the same.

It should be noted that a function of the second parasitic structure is similar to that of the first parasitic structure. For the function of the second parasitic structure, reference may be made to content of the foregoing embodiments. Details are not described in this application again.

In summary, the multi-band antenna structure provided in this application includes the second parasitic structure of the second antenna element. The second parasitic structure includes the one or more FSS planes, and the second parasitic structure has the stopband characteristic for the second antenna element and has the passband characteristic for the first antenna element. Therefore, the second parasitic structure is equivalent to a continuous metal conductor in the operating frequency band of the second antenna element, and is equivalent to a vacuum in the operating frequency band of the first antenna element. This can implement the desired "targeting" optimization function, so that problems such as polarization suppression ratio deterioration and a gain drop that occur, at some frequencies, in the radiation pattern of the second antenna element can be resolved. The FSS plane of the second parasitic structure may be formed by evenly arranging the plurality of FSS cells. This can better implement the desired "targeting" optimization function, so that the problems such as polarization suppression ratio deterioration and a gain drop that occur, at some frequencies, in the radiation pattern of the second antenna element can be resolved. Further, in this application, the FSS cell may be a miniaturized FSS cell. Therefore, "targeting" optimization can be performed on the radiation pattern of the second antenna element, and the radiation pattern of the first antenna element in the adjacent space is not affected while the radiation pattern of the second antenna element is optimized. Furthermore, in this application, the FSS cell may use the non-rotationally symmetric structure, so that the second parasitic structure can be better applicable to the near-field region.

If the multi-band antenna structure includes antenna elements with only two frequency bands, for example, the first antenna element and the second antenna element, the multi-band antenna structure may also be referred to as a dual-band antenna structure. Actually, the multi-band antenna structure may include antenna elements with two frequency bands, or may include antenna elements with more frequency bands. The following describes the antenna structure by using an example in which the multi-band antenna structure further includes a third antenna element.

The multi-band antenna structure further includes the third antenna element and a third parasitic structure, where an operating frequency band of the third antenna element is different from the operating frequency bands of both the first antenna element and the second antenna element, and the third antenna element and the third parasitic structure are disposed above the reflection panel, and the third parasitic structure includes one or more FSS planes, the third parasitic structure has a stopband characteristic for the third antenna element and has a passband characteristic for the first antenna element and the second antenna element, and both the first parasitic structure and the second parasitic structure have a passband characteristic for the third antenna element.

In a possible design, reflectivity of the third parasitic structure relative to the third antenna element is greater than 60%, a reflection phase shift ranges from 135 degrees to 225 degrees, transmittance of the third parasitic structure relative to the first antenna element and the second antenna element is greater than 60%, and a transmission phase shift ranges from −45 degrees to 45 degrees. Transmittance of the first parasitic structure relative to the third antenna element is greater than 60%, and a transmission phase shift ranges from −45 degrees to 45 degrees. Likewise, transmittance of the second parasitic structure relative to the third antenna element is greater than 60%, and a transmission phase shift ranges from −45 degrees to 45 degrees In a possible design, when the third parasitic structure includes a plurality of FSS planes, structures of the FSS planes are identical or different.

In a possible design, the FSS plane of the third parasitic structure is disposed between a top of the third antenna element and the reflection panel, and an included angle between the FSS plane and the reflection panel is greater than 30 degrees.

In a possible design, the FSS plane of the third parasitic structure is formed by evenly arranging a plurality of FSS cells.

In a possible design, the FSS cell of the third parasitic structure is of a closed annular conductor structure or a closed annular slotted structure.

In a possible design, the closed annular conductor structure includes a bent winding pattern structure, and the closed annular slotted structure includes a bent winding pattern structure.

In a possible design, a minimum width of a conductor strip or a slotted strip in the bent winding pattern structure is less than 0.02 times the maximum vacuum wavelength of the third antenna element.

In a possible design, the FSS cell that forms the third parasitic structure is of a non-rotationally symmetric structure.

In a possible design, a shape of the FSS cell that forms the third parasitic structure is rectangular or circular.

In a possible design, when the shape of the FSS cell that forms the third parasitic structure is rectangular, a maximum side length of the FSS cell is less than 0.2 times the maximum vacuum wavelength of the third antenna element, or when the shape of the FSS cell that forms the third parasitic structure is circular, a diameter of the FSS cell is less than 0.2 times the maximum vacuum wavelength of the third antenna element.

In a possible design, an area of the FSS plane of the third parasitic structure is less than a 1-square vacuum wavelength of the third antenna element.

In a possible design, the multi-band antenna structure includes a plurality of third parasitic structures and an antenna array that includes a plurality of third antenna elements, where the plurality of third antenna elements are in a one-to-one correspondence with the plurality of third parasitic structures, and distances between the third antenna elements and the corresponding third parasitic structures are the same.

It should be noted that a function of the third parasitic structure is similar to that of the first parasitic structure. For the function of the third parasitic structure, reference may be made to content of the foregoing embodiments. Details are not described in this application again.

In summary, the multi-band antenna structure provided in this application includes the third antenna element and the third parasitic structure of the third antenna element. The third parasitic structure includes the one or more FSS planes, and the third parasitic structure has the stopband characteristic for the third antenna element and has the passband characteristic for the first antenna element and the second antenna element. Therefore, the third parasitic structure is equivalent to a continuous metal conductor in the operating frequency band of the third antenna element, and is equivalent to a vacuum in the operating frequency bands of the first antenna element and the second antenna element. This can implement the desired "targeting" optimization function, so that problems such as polarization suppression ratio deterioration and a gain drop that occur, at some frequencies, in a radiation pattern of the third antenna element can be resolved. The FSS plane of the third parasitic structure may be formed by evenly arranging the plurality of FSS cells. This can better implement the desired "targeting" optimization function, so that the problems such as polarization suppression ratio deterioration and a gain drop that occur, at some frequencies, in the radiation pattern of the third antenna element can be resolved. Further, in this application, the FSS cell may be a miniaturized FSS cell. Therefore, "targeting" optimization can be performed on the radiation pattern of the third antenna element, and the radiation patterns of the first antenna element and the second antenna element in adjacent space are not affected while the radiation pattern of the third antenna element is optimized. Furthermore, in this application, the FSS cell may use the non-rotationally symmetric structure, so that the third parasitic structure can be better applicable to the near-field region.

What is claimed is:

1. A multi-band antenna structure, comprising:

a first antenna element;

a second antenna element;

a reflection panel; and a first parasitic structure of the first antenna element;

wherein operating frequency bands of the first antenna element and the second antenna element are different, wherein the first antenna element, the second antenna element, and the first parasitic structure are disposed above the reflection panel, and wherein a distance between the reflection panel and an antenna element with a higher operating frequency band in the first antenna element and the second antenna element is less than a distance between the reflection panel and an antenna element with a lower operating frequency band in the first antenna element and the second antenna element;

wherein the first parasitic structure comprises one or more frequency selective surfaces (FSSs);

wherein the first parasitic structure has a stopband characteristic for the first antenna element and has a passband characteristic for the second antenna element; and wherein the first antenna element and the second antenna element are adjacent to each other, wherein a distance between the first antenna element and the second antenna element is less than 0.5 times a vacuum wavelength corresponding to the lower of the operating frequency bands of the first antenna element and the second antenna element, wherein a distance between the first antenna element and the first parasitic structure is less than 0.5 times a vacuum wavelength corresponding to an operating frequency band of the first antenna element, and wherein a distance between the second antenna element and the first parasitic structure is less than 0.5 times a vacuum wavelength corresponding to an operating frequency band of the second antenna element.

2. The multi-band antenna structure according to claim 1, wherein a reflectivity of the first parasitic structure relative to the first antenna element is greater than 60%, wherein a reflection phase shift of the first parasitic structure ranges from 135 degrees to 225 degrees, wherein a transmittance of the first parasitic structure relative to the second antenna element is greater than 60%, and wherein a transmission phase shift of the first parasitic structure ranges from −45 degrees to 45 degrees.

3. The multi-band antenna structure according to claim 1, wherein the first parasitic structure comprises a plurality of FSSs, wherein FSSs of the plurality of FSSs have structures that are identical or different.

4. The multi-band antenna structure according to claim 1, wherein the at least one of the one or more FSSs is disposed between a top of the first antenna element and the reflection panel, and wherein an included angle between the at least one of the one or more FSSs and the reflection panel is greater than 30 degrees.

5. The multi-band antenna structure according to claim 1, the at least one of the one or more FSSs comprises a plurality of FSS cells that are evenly arranged.

6. The multi-band antenna structure according to claim 5, wherein each FSS cell of the plurality of FSS cells has one of a closed annular conductor structure or a closed annular slotted structure.

7. The multi-band antenna structure according to claim 6, wherein the one of the closed annular conductor structure or the closed annular slotted structure comprises a bent winding pattern structure.

8. The multi-band antenna structure according to claim 7, wherein the bent winding pattern structure comprises at least one of a conductor strip or a slotted strip, and wherein the at least one of the conductor strip or the slotted strip has a minimum width less than 0.02 times a maximum vacuum wavelength of the first antenna element.

9. The multi-band antenna structure according to claim 5, wherein each FSS cell of the plurality of FSS cells has a non-rotationally symmetric structure.

10. The multi-band antenna structure according to claim 5, wherein each FSS cell of the plurality of FSS cells has a shape that is rectangular or circular.

11. The multi-band antenna structure according to claim 10, wherein the shape of each FSS cell of the plurality of FSS cells is one of rectangular with a maximum side length of the respective FSS cell being less than 0.2 times the maximum vacuum wavelength of the first antenna element, or circular with a diameter of the respective FSS cell being less than 0.2 times the maximum vacuum wavelength of the first antenna element.

12. The multi-band antenna structure according to claim 1, wherein an area of each FSS of the one or more FSSs is less than a 1-square vacuum wavelength of the first antenna element.

13. The multi-band antenna structure according to claim 1, wherein the first parasitic structure is a part of a plurality of first parasitic structures, wherein the first antenna element is a part of a plurality of first antenna elements, and wherein the antenna structure further comprises an antenna array comprising the plurality of first antenna elements, wherein each first antenna element of the plurality of first antenna elements is in a one-to-one correspondence with a first parasitic structure of the plurality of first parasitic structures, and wherein each first antenna element of the plurality of antenna elements has a same distance between the respective first antenna elements and the corresponding first parasitic structure.

14. The multi-band antenna structure according to claim 1, further comprising a second parasitic structure, wherein the second parasitic structure is disposed above the reflection panel, wherein the second parasitic structure comprises one or more second FSSs, and wherein the second parasitic structure has a passband characteristic for the first antenna element and has a stopband characteristic for the second antenna element; and wherein a distance between the first antenna element and the second parasitic structure is less than 0.5 times the vacuum wavelength corresponding to the operating frequency band of the first antenna element, and wherein a distance between the second antenna element and the second parasitic structure is less than 0.5 times the vacuum wavelength corresponding to the operating frequency band of the second antenna element.

15. The multi-band antenna structure according to claim 14, further comprising a third antenna element and a third parasitic structure;

wherein an operating frequency band of the third antenna element is different from the operating frequency band of the first antenna element and from the operating frequency band of the second antenna element, and wherein the third antenna element and the third parasitic structure are disposed above the reflection panel; and wherein the third parasitic structure comprises one or more FSSs, wherein the third parasitic structure has a stopband characteristic for the third antenna element and has a passband characteristic for the first antenna element and the second antenna element, and wherein the first parasitic structure and the second parasitic structure each have a passband characteristic for the third antenna element.

16. An apparatus, comprising:

a first antenna element;

a second antenna element;

a reflection panel; and a first parasitic structure associated with the first antenna element;

wherein a first operating frequency band of the first antenna element is different from a second operating frequency band of the second antenna element;

wherein the first antenna element, the second antenna element, and the first parasitic structure are disposed above the reflection panel, and wherein a distance between the reflection panel and a higher frequency antenna element is less than a distance between the reflection panel and a lower frequency antenna element wherein the higher frequency antenna element is an antenna element that is one of the first antenna element and the second antenna element of an antenna element and that has a higher operating frequency band;

wherein the lower frequency antenna element is one of the first antenna element or the second antenna element other than the higher frequency antenna element;

wherein the first parasitic structure comprises a frequency selective surface (FSS);

wherein the first parasitic structure has a stopband characteristic for the first antenna element and has a passband characteristic for the second antenna element;

wherein a distance between the first antenna element and the second antenna element is less than 0.5 times a vacuum wavelength corresponding to the operating frequency bands of the lower frequency antenna element; and wherein a distance between the first antenna element and the first parasitic structure is less than 0.5 times a vacuum wavelength corresponding to an operating frequency band of the first antenna element, and wherein a distance between the second antenna element and the first parasitic structure is less than 0.5 times a vacuum wavelength corresponding to an operating frequency band of the second antenna element.

17. The apparatus according to claim 16, wherein the FSS comprises a plurality of FSS cells that are evenly arranged, and wherein each FSS cell of the plurality of FSS cells has one of a closed annular conductor structure or a closed annular slotted structure.

18. The apparatus according to claim 17, wherein the one of the closed annular conductor structure or the closed annular slotted structure comprises a bent winding pattern structure, wherein the bent winding pattern structure comprises at least one of a conductor strip or a slotted strip, and wherein the at least one of the conductor strip or the slotted strip has a minimum width less than 0.02 times a maximum vacuum wavelength of the first antenna element.

19. An apparatus, comprising:

a first antenna element;

a second antenna element;

a reflection panel;

a first parasitic structure associated with the first antenna element; and a second parasitic structure associated with the second antenna element;

wherein a first operating frequency band of the first antenna element is different from a second operating frequency band of the second antenna element;

wherein the first antenna element, the second antenna element, the first parasitic structure, and the second parasitic structure are disposed above the reflection panel;

wherein respective distances between the reflection panel and each of the first antenna element and second antenna element is associated with an operating frequency band of the respective antenna element wherein the first parasitic structure comprises a first frequency selective surface (FSS);

wherein the first parasitic structure has a stopband characteristic for the first antenna element and has a passband characteristic for the second antenna element;

wherein the second parasitic structure comprises a second FSS;

wherein the second parasitic structure has a passband characteristic for the first antenna element and has a stopband characteristic for the second antenna element;

wherein a distance between the first antenna element and the second antenna element is less than 0.5 times a vacuum wavelength corresponding the lower of the operating frequency band of the first antenna element and second antenna element;

wherein a distance between the first antenna element and the first parasitic structure is less than 0.5 times a vacuum wavelength corresponding to an operating frequency band of the first antenna element, and wherein a distance between the second antenna element and the first parasitic structure is less than 0.5 times a vacuum wavelength corresponding to an operating frequency band of the second antenna element; and wherein a distance between the first antenna element and the second parasitic structure is less than 0.5 times the vacuum wavelength corresponding to the operating frequency band of the first antenna element, and wherein a distance between the second antenna element and the second parasitic structure is less than 0.5 times the vacuum wavelength corresponding to the operating frequency band of the second antenna element.

20. The apparatus according to claim 19, wherein the FSS comprises a plurality of FSS cells, wherein each FSS cell of the plurality of FSS cells has one of a closed annular conductor structure or a closed annular slotted structure, wherein the one of the closed annular conductor structure or the closed annular slotted structure comprises a bent winding pattern structure, wherein the bent winding pattern structure comprises at least one of a conductor strip or a slotted strip, and wherein the at least one of the conductor strip or the slotted strip has a minimum width associated with a maximum vacuum wavelength of the first antenna element.

* * * * *